US010344515B2

(12) United States Patent
Ishii et al.

(10) Patent No.: US 10,344,515 B2
(45) Date of Patent: Jul. 9, 2019

(54) TRAVEL ASSISTANCE DEVICE AND SLIDING DOOR DEVICE PROVIDED WITH SAME

(71) Applicant: Panasonic Intellectual Property Management Co., Ltd., Osaka (JP)

(72) Inventors: Masashi Ishii, Osaka (JP); Shinji Adachi, Osaka (JP); Tomoyasu Hirano, Osaka (JP); Yoshiaki Kaji, Osaka (JP); Koya Tanaka, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 24 days.

(21) Appl. No.: 15/557,244

(22) PCT Filed: Mar. 4, 2016

(86) PCT No.: PCT/JP2016/001187
§ 371 (c)(1),
(2) Date: Sep. 11, 2017

(87) PCT Pub. No.: WO2016/147588
PCT Pub. Date: Sep. 22, 2016

(65) Prior Publication Data

US 2018/0058121 A1 Mar. 1, 2018

(30) Foreign Application Priority Data

Mar. 13, 2015 (JP) ..... 2015-050329

(51) Int. Cl.
*E05D 15/06* (2006.01)
*E05F 1/04* (2006.01)
*E05F 1/02* (2006.01)

(52) U.S. Cl.
CPC ..... *E05D 15/063* (2013.01); *E05D 15/06* (2013.01); *E05D 15/0604* (2013.01);
(Continued)

(58) Field of Classification Search
CPC ..... E05F 1/046; E05F 1/02; E05D 15/063; E05D 15/0652
See application file for complete search history.

(56) References Cited

U.S. PATENT DOCUMENTS 3,074,124 A * 1/1963 Bergstedt ..... E05D 15/063 312/333
6,360,487 B1 * 3/2002 Kern ..... E06B 3/4636 160/197
(Continued)

FOREIGN PATENT DOCUMENTS

JP 58-54540 Y2 12/1983
JP 3047773 U 2/1998
(Continued)

OTHER PUBLICATIONS

International Search Report for International Application No. PCT/JP2016/001187, dated May 17, 2016.

*Primary Examiner* — Justin B Rephann
(74) *Attorney, Agent, or Firm* — Renner Otto Boisselle & Sklar, LLP

(57) ABSTRACT

A travel assistance device includes a first rail inclined downward from a first end portion side to a second end portion side in longitudinal direction, a second rail provided parallel to the first rail and inclined, in opposite direction to the first rail, downward from the second end portion to the first end portion in the longitudinal direction, a holding member having a runner portion slidably guided by the rails and holding a travelling body, and a switch mechanism configured to be switched between a state in which the runner portion is guided by the first rail and is assisted to travel downward on the first rail by a load applied to the runner portion and a state in which the runner portion is
(Continued)

guided by the second rail and is assisted to travel downward on the second rail by the load applied to the runner portion.

18 Claims, 12 Drawing Sheets

(52) U.S. Cl.
CPC ..... *E05D 15/0652* (2013.01); *E05F 1/02* (2013.01); *E05F 1/046* (2013.01)

(56) References Cited

U.S. PATENT DOCUMENTS

| | | | | |
|---|---|---|---|---|
| 7,178,638 | B2 * | 2/2007 | Fujita | B66B 13/24 187/313 |
| 7,861,461 | B2 * | 1/2011 | Nakano | E05F 1/02 49/226 |
| 10,006,238 | B2 * | 6/2018 | Hashimoto | E05F 13/04 |

FOREIGN PATENT DOCUMENTS

| | | | |
|---|---|---|---|
| JP | 3960434 | B2 | 5/2007 |
| JP | 2011-84889 | A | 4/2011 |
| JP | 3172882 | U | 12/2011 |
| JP | 5452674 | B2 | 1/2014 |

* cited by examiner

TRAVEL ASSISTANCE DEVICE AND SLIDING DOOR DEVICE PROVIDED WITH SAME

BACKGROUND OF THE INVENTION

Field of the Invention

The present disclosure relates to a travel assistance device and a sliding door device provided with the same.

Description of the Related Art

A conventionally known travel assistance device assists travelling of various travelling bodies such as a door body along a rail. The travel assistance device is sometimes provided with a mechanism assisting the travelling of the travelling body. For instance, a well-known sliding door device provided with the door body that opens or closes an opening, i.e. an entrance or the like, is provided with a mechanism that assists sliding of the door body on an opening side or on a closing side.

Patent Literatures 1 and 2 below disclose a device in which a door is provided with a gearbox having a gear wheel engaging with a rack provided on the rail, a flat spiral spring storing elastic force by rotation of the gear wheel, or the like.

Patent Literature 3 below discloses a door guide device automatically closing or automatically opening a sliding door in such a manner that a guide rail guiding the slide door is tilted to a central part in the longitudinal direction.

CITATION LIST

Patent Literature

PTL 1: Japanese Patent No. 3960434

PTL 2: Japanese Utility Model Registration No. 3172882

PTL 3: Japanese Unexamined Patent Application Publication No. 2011-84889

SUMMARY OF THE INVENTION

Problems to be Solved by the Invention

In the devices described in Patent Literatures 1 and 2, if there is an error in an attached object of the rail or at a time of attaching, the rack and the gear wheel do not become engaged with each other, or abrasion of the rack and the gear wheel or deterioration over time in the flat spiral spring easily occurs.

In the door guide device described in Patent Literature 3, the relatively long guide rail needs to be tilted, the structure becomes complicated since a mechanism for holding such an inclined state needs to be provided, and the deterioration over time easily occurs.

The present invention is proposed in view of the above-mentioned problems. An object of the present invention is to provide a travel assistance device and a sliding door device provided with the travel assistance device, hereinafter referred to as the sliding door device; the travel assistance device assists the travelling on both sides in rail longitudinal direction of the travelling body that travels along the rail, simplifies the structure, and enhances the durability.

Means of Solving the Problems

In order to achieve the above-mentioned object, a travel assistance device of one aspect of the present invention includes a first rail inclined downward from a first end portion side to a second end portion side in longitudinal direction, a second rail provided parallel to the first rail and inclined, in opposite direction to the first rail, downward from the second end portion to the first end portion in the longitudinal direction, a holding member having a runner portion slidably guided by the rails and holding a travelling body, and a switch mechanism configured to be switched between a state in which the runner portion is guided by the first rail and is assisted to travel downward on the first rail by a load applied to the runner portion and a state in which the runner portion is guided by the second rail and is assisted to travel downward on the second rail by the load applied to the runner portion.

In order to achieve the above-mentioned object, a sliding door device of one aspect of the present invention includes the travel assistance device of one aspect of the present invention and a door body of the travelling body assisted to travel by the travel assistance device.

Effects of the Invention

Constituted as above, the travel assistance device and the sliding door device of one aspect of the present invention is able to assist the travelling of the travelling body that travels along the rail on both sides in the rail longitudinal direction, which simplifies the structure and enhancing the durability.

DESCRIPTION OF THE EMBODIMENTS

Figure 1A:
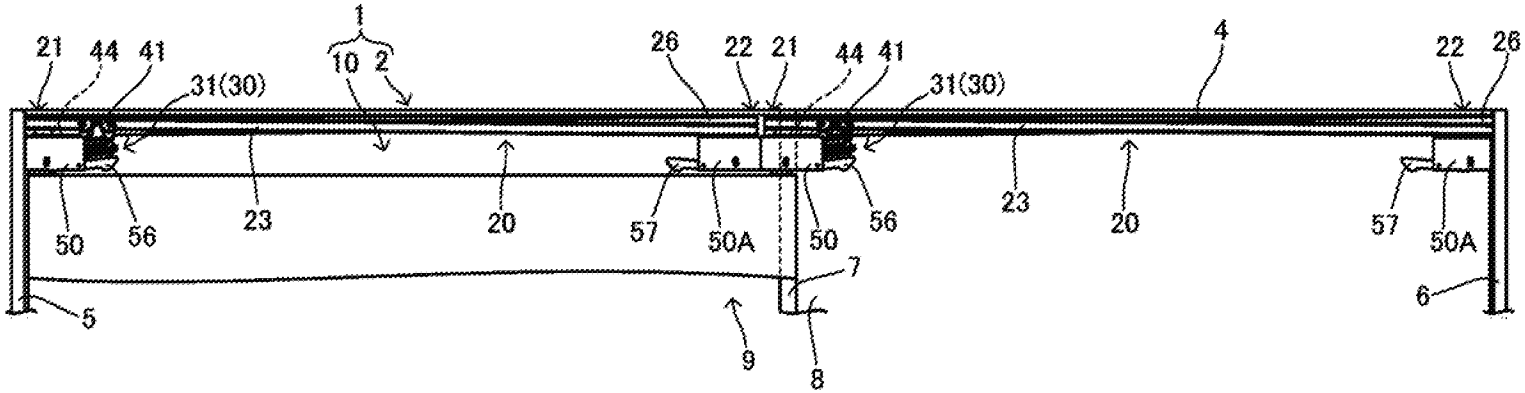
FIGS. 1A and 1B schematically illustrate an example of the travel assistance device and the sliding door device of an embodiment of the present invention, and are schematic front views partially broken and omitted.

An embodiment of the present invention is explained below based on the drawings.

Some of the detailed reference numerals allotted to the other figures are omitted in some figures.

In each embodiment to be mentioned below, direction such as the vertical direction is explained based on an executed state of a travel assistance device and the sliding door device in each embodiment.

FIGS. 1 to 9 schematically illustrate the travel assistance device and the sliding door device of a first embodiment.

Figure 2A:
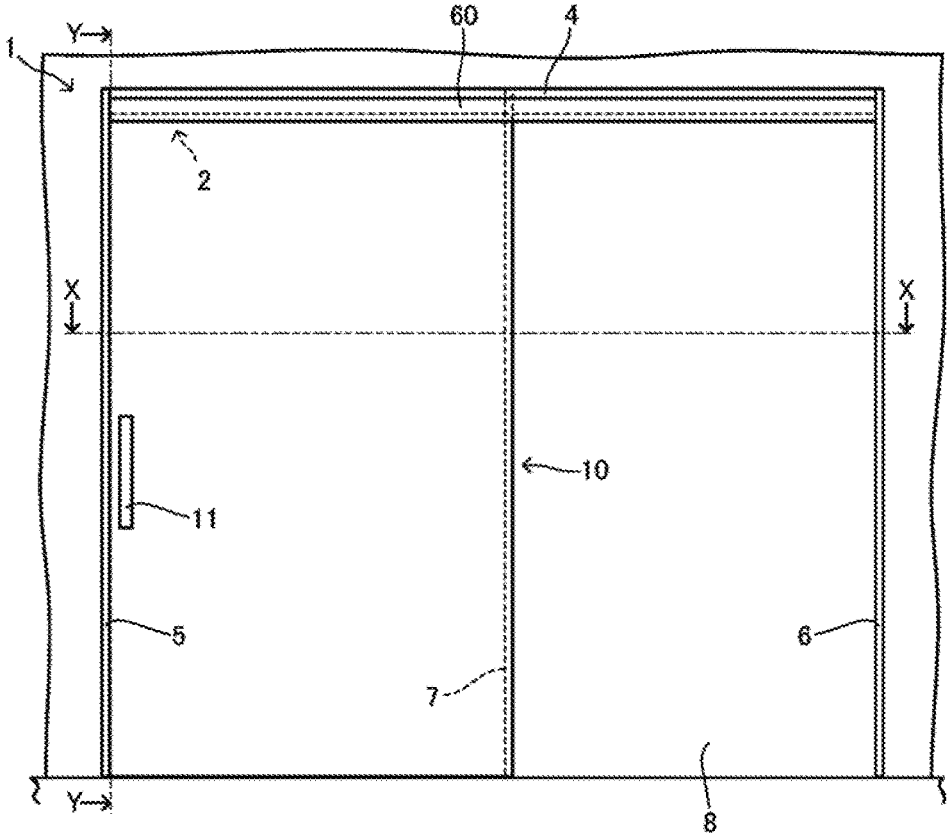
FIG. 2A is a partially broken schematic front view schematically illustrating a state of an executed example of an embodiment of the sliding door device.
Figure 2B:
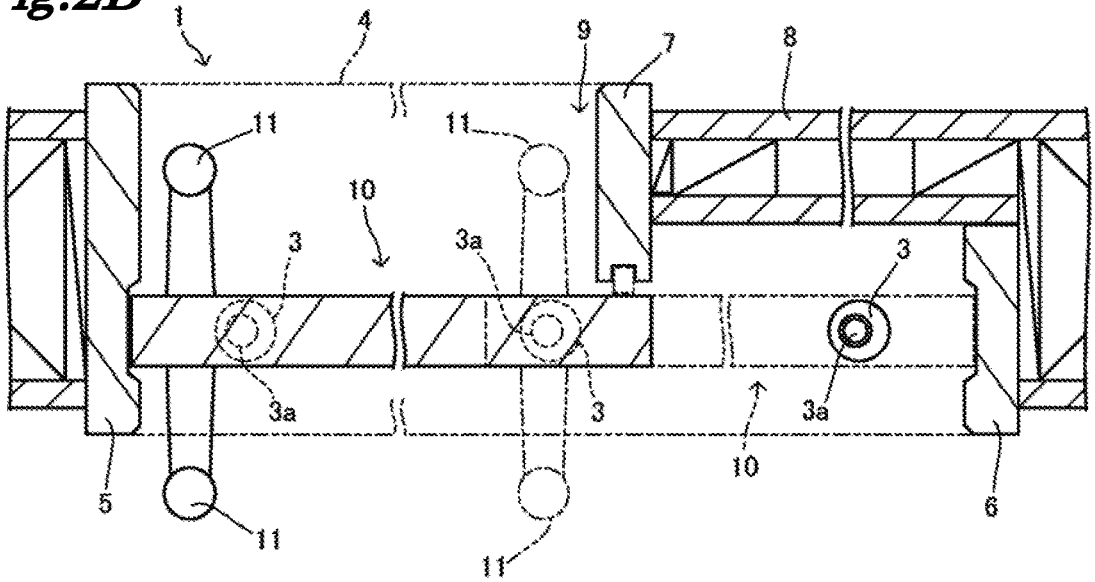
FIG. 2B is a schematic cross sectional view partially broken and corresponding to the direction of the arrows substantially along the line X-X in FIG. 2A.
Figure 3:
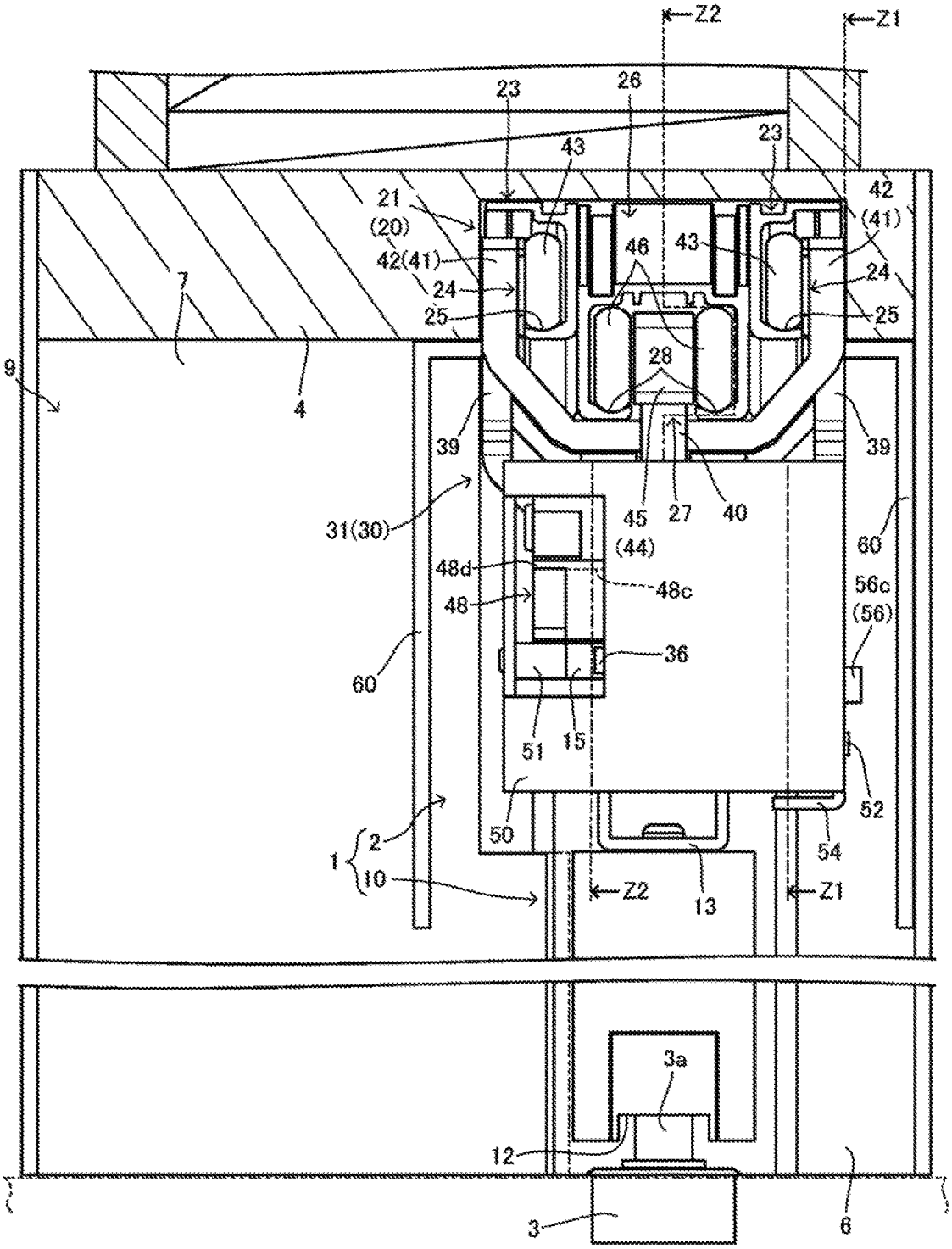
FIG. 3 is a schematic longitudinal sectional view partially broken and corresponding to the direction of the arrows substantially along the line Y-Y in FIG. 2A.

As illustrated in FIGS. 1 to 3, a sliding door device 1 of the embodiment includes a travel assistance device 2 of the embodiment and a door body 10 of a travelling body that is assisted to travel by the travel assistance device 2.

As illustrated in FIGS. 1 to 4, the travel assistance device 2 includes a first rail 23 that is inclined downward from a first end portion 21 side to a second end portion 22 side in the longitudinal direction. The travel assistance device 2 further includes a second rail 26 that is provided parallel to the first rail 23 and is inclined, in opposite direction to the first rail 23, downward from the second end portion 22 side to the first end portion 21 side in the longitudinal direction. The travel assistance device 2 includes a holding member 30 having runners 41, 44 that are slidably guided by the rails 23, 26 and hold the door body 10.

In the embodiment, the travel assistance device 2 is configured to include a plurality of holding members 30, 30 that hold the door body 10 at a plurality of regions apart from each other in the door width direction, longitudinal direction of the rail, hereinafter referred to as rail longitudinal direction. The travel assistance device 2 is configured to be provided in tandem with a plurality of first rails 23, 23 and second rails 26, 26 that respectively guide the runners 41, 44, 41, 44 of the plurality of holding members 30, 30.

As illustrated in FIG. 2, the sliding door device 1 is configured to be provided with the door body 10 so as to open or close an opening 9, i.e. an entrance or the like, provided for a wall body such as a partition wall.

The sliding door device 1 is not limited to installing in a dwelling or the like and can be installed in a public facility such as a medical facility or a welfare facility, a commercial facility, various types of stores, or a plant. The sliding door device 1 can be installed outdoors, not limited to indoors.

In the embodiment, the sliding door device 1 is configured to include the single door body 10 that is arranged in a single sliding state. The figures illustrate an example in which the door body 10 is fitted by a wing wall housing that is provided with a wing wall 8. The figures also illustrate an example in which the door body 10 is fitted in a door frame including an upper frame 4, a door tip side longitudinal frame 5, a door end side longitudinal frame 6, and a mullion 7 (an intermediate longitudinal frame). An upper side and both sides in opening width direction of the opening 9 are defined by the upper frame 4, the door tip side longitudinal frame 5, and the mullion 7. A lower side of the opening 9 can be defined by a floor face or by a lower frame.

The door frames 4, 5, 6, 7 can be fixed by an appropriate frame substrate. The sliding door device 1 can be deemed as such that the door frames 4, 5, 6, 7 are provided. The figures illustrate an example in which the door frames 4, 5, 6, 7 are in a fixed frame state but can be in a casing frame state provided with a casing trim. Without being provided with the door frames, the opening 9 can be defined by an interior finish face that is finished by a cloth in a frameless state or any other finish face.

In the embodiment, as illustrated in FIGS. 2A and 3, the sliding door device 1 is configured to include cover members 60, 60 that respectively cover both sides of the travel assistance device 2 in the rail width direction, i.e. the door thickness direction. The cover members 60, 60 are in a band plate shape (a side board shape) that is long along the rail longitudinal direction, and are arranged so as to cover a gap between the upper frame 4 being an attached object of the respective rails 23, 26 of the travel assistance device 2, and the door body 10. Namely, the cover members 60, 60 are configured to cover the gap between a depth face of the door frame 4 facing downward and an upper end face of the door body 10.

As illustrated in FIG. 2A, the cover member 60 on an opposite side to the wing wall of the door body 10 has a linear dimension in accordance with a dimension along the door width direction from the door tip side longitudinal frame 5 to the door end side longitudinal frame 6. The cover member 60 on a wing wall face side of the door body 10 has a linear dimension in accordance with a dimension along the door width direction from the door tip side longitudinal frame 5 to the mullion 7 (refer to FIG. 3).

The cover members 60, 60 can be fixed to the upper frame 4 or the like by a bolt, glue, or the like. In place of such an aspect in which the cover members 60, 60 are provided, the aspect can be such that the upper frame 4 is provided with a cover portion covering the gap between the upper frame 4 and the door body 10, or can also be such that the travel assistance device 2 is exposed without being provided with the cover members 60, 60 or the cover portion.

The door body 10 is substantially in a rectangular flat plate shape. As illustrated in FIG. 2, pulls 11, 11 are provided on both sides in the door thickness direction of a door tip side end portion of the door body 10. In the embodiment, the pulls 11, 11 are not in an excavated shape and are in a bar shape extending vertically. The pulls 11, 11 are constituted substantially similar to each other and are provided so as to be at a position overlapping each other seen from the door thickness direction.

In such a state in which the door body 10 closes the opening 9, the pulls 11, 11 are provided so as to form a gap between the pulls 11, 11 and the door tip side longitudinal frame 5 for inserting fingers. The pull 11 provided on the wing wall face side of the door body 10 is provided so as to form a gap between the pull 11 and the mullion 7 for inserting fingers when the door body 10 is fully open. In other words, the door body 10 is constituted in such a manner that, in a fully open state, a door tip side region including the pulls 11, 11 is disposed so as to project toward the opening 9 side further than an inside face of the mullion 7 facing the opening 9 side. Namely, the door body 10 is fitted so as to form a so-called non-pulled part. The pulls 11, 11 or the like of the door body 10 can be provided with a lock mechanism that is able to be locked or unlocked.

A door width dimension of the door body 10 can be appropriately set in accordance with an opening width of the opening 9 so as to close the opening 9. In the embodiment, as illustrated in FIG. 2B, the door width dimension of the door body 10 is set in such a manner that a door end portion of the door body 10 and the mullion 7 overlap each other seen from the door thickness direction when the opening 9 is closed. The opening width of the opening 9 can be appropriately set in view of accessibility or barrier-free or in accordance with a dimension of the un-pulled part of the door body 10 in order that an effective opening width becomes, for example, equal to or more than 750 mm, or equal to or more than 1000 mm. As illustrated in FIGS. 2A and 3, a height dimension of the door body 10 can be set so as to extend from a vicinity of a floor face to vicinities of the respective rails 23, 26. For instance, the height dimension of the door body 10 can be from 1800 mm to 2500 mm. A door thickness dimension of the door body 10 can be, for example, from 20 mm to 40 mm. The above respective dimensions of the door body 10 can be appropriately set according to an installation site or an intended use of the sliding door device 1.

As illustrated in FIGS. 2B and 3, the sliding door device 1 includes a lower end guiding member 3 that guides a lower end side of the door body 10. In the embodiment, the door body 10 is configured to include a recessed groove 12 opening downward and provided along the door width direction on a lower end portion; the lower end guiding member 3 is configured to include a guide pin 3*a* that is loosely inserted into the recessed groove 12. As illustrated in FIG. 2B, the lower end guiding member 3 is provided at a plurality of regions so as to be located immediately below a movement locus of the door body 10 moving between a closed position and a fully open position. The lower end guiding member 3 can be provided in such a manner that at least one lower end guiding member 3 exists immediately below the door body 10 moving between the closed position and the fully open position. The lower end guiding member 3 can be a magnet guide that houses the guide pin 3*a* provided with a magnet freely retractable in the vertical direction, and that is disposed so as to be embedded in a floor. In such a case, the recessed groove 12 of the door body 10 can be provided with the magnet or a magnetic member corresponding to the lower end guiding member 3.

As illustrated in FIG. 2B, the lower end guiding member 3 or the like, which is always arranged at a position overlapping the door body 10 moving between the closed position and the fully open position, can be a fixed guide member that is provided with a guide portion, i.e. the guide pin, arranged so as not to be retractable in the vertical direction.

The embodiment is not limited to such that the door body 10 is fitted by the wing wall housing as illustrated in the figures and can be such that the door body 10 is fitted in an outset housing. The embodiment is not limited to such that a single door body 10 is arranged in the single sliding state and can be such that two door bodies 10 are arranged in a separately sliding state. In such a case, travel assistance devices 2, 2 to be mentioned later can be arranged in pairs in order to assist the travelling of each door body 10. The opening 9 is not limited to the entrance or the like or can be the opening 9 of various storages or the like.

The travel assistance device 2, which assists or guides the travelling of the door body 10, has a function that assists the travelling of the door body 10 on an opening side or on a closing side.

The travel assistance device 2 includes a switch mechanism 31 that is configured to be switched between a state in which the runners 41, 44 are guided by the first rail 23 and are assisted to travel downward on the first rail 23 by a load applied to the runners 41, 44, and a state in which the runners 41, 44 are guided by the second rail 26 and are assisted to travel downward on the second rail 26 by the load applied to the runners 41, 44.

In the embodiment, as illustrated in FIGS. 1, 3 or the like, the runners 41, 44 are configured to include a first runner 41 that is slidably engaged with and is guided by the first rail 23 and a second runner 44 that is slidably engaged with and is guided by the second rail 26. The switch mechanism 31 is configured to be switched between a state in which the load is applied onto the first runner 41 side and a state in which the load is applied onto the second runner 44 side.

In the embodiment, as illustrated in FIG. 1, the travel assistance device 2 is configured to include a pair of holding members 30, 30 that is connected to respective upper end sides of the door tip side end portion and the door end portion of the door body 10. Two rail units 20, 20 in which the first rails 23, 23 and the second rails 26, 26 are respectively provided in parallel are configured to be provided in tandem along the door width direction so as to respectively guide the holding members 30, 30.

The rail units 20, 20 have a linear dimension that is substantially one half of a dimension along the door width direction from a door tip side end face of the door body 10 at the closed position to a door end portion face of the door body 10 at the fully open position, and are respectively provided on the opening 9 side and a wing wall 8 side. The rail units 20, 20 are provided so as to be located at the same height and so as to be located corresponding to the door thickness direction. Namely, the rail units 20, 20 are provided so as to be located overlapping each other seen from the rail longitudinal direction.

The rail unit 20 on the opening 9 side is disposed in such a manner that a first end portion 21 in the longitudinal direction abuts on or is close to the door tip side longitudinal frame 5 and a second end portion 22 in the longitudinal direction is disposed so as to be located adjacent to the mullion 7. The rail unit 20 on the opening 9 side guides the holding member 30 connected to the upper end side of the door tip side end portion of the door body 10 in the rail longitudinal direction.

The rail unit 20 on the wing wall 8 side is disposed in such a manner that the first end portion 21 in the longitudinal direction abuts on or is close to the second end portion 22 of the rail unit 20 on the opening 9 side and the second end portion 22 in the longitudinal direction abuts on or is close to the door end side longitudinal frame 6. The rail unit 20 on the wing wall 8 side guides the holding member 30 connected to the upper end side of the door end portion of the door body 10 along the rail longitudinal direction.

The rail units 20, 20 can be fixed to the upper frame 4 being the attached object by the bolt, glue, or the like. The figures illustrate an example in which the upper frame 4 is provided with a recessed groove that opens downward and receives upper side regions of the rail units 20, 20 along the longitudinal direction. In place of such an aspect, the aspect can be such that the upper frame 4 is configured to be provided with the recessed groove that receives almost the entirety of rail units 20, 20 or can be such that the rail units 20, 20 are attached onto a lower face of the upper frame 4 without being provided with the recessed groove.

In the embodiment, mechanisms 20, 30, 50, 50A that assist the travelling on a door tip side end portion side of the door body 10 including the rail units 20, 20 and mechanisms 20, 30, 50, 50A that assist the travelling on a door end portion side of the door body 10 are similarly constituted with each other. Therefore, the mechanisms 20, 30, 50, 50A that assist the travelling of the door tip side end portion being one side are exemplified and mainly explained below. In FIG. 9, the mechanisms 20, 50 that assist the travelling on the door end portion side of the door body 10 are not illustrated and omitted.

The first rail 23 and the second rail 26 of the rail unit 20 are arranged over a total length from the first end portion 21 to the second end portion 22 of the rail unit 20 so as to have both ends in the longitudinal direction located in a matched position to each other in the longitudinal direction.

The first rail 23 is inclined downward from the first end portion 21 to the second end portion 22 in a downward slope state. The second rail 26 is inclined downward from the second end portion 22 to the first end portion 21 in the downward slope state. In the embodiment, the first rail 23 and the second rail 26 are provided in parallel in the door thickness direction. The first rail 23 and the second rail 26 are provided in a crossed state seen from the door thickness direction. The first rail 23 and the second rail 26 are provided in parallel in such a manner that a cross portion of the first rail 23 and the second rail 26 is located substantially in a center of the longitudinal direction. An upper edge on the first end portion 21 side of the first rail 23 and an upper edge on the second end portion 22 side of the second rail 26 are configured to be at the same height, and a lower edge on the second end portion 22 side of the first rail 23 and a lower edge on the first end portion 21 side of the second rail 26 are configured to be at the same height (also refer to FIGS. 5 and 9). In both end portions 21, 22 in the longitudinal direction, a part of the first rail 23 and a part of the second rail 26 are configured to overlap each other seen from the door thickness direction.

Figure 4:
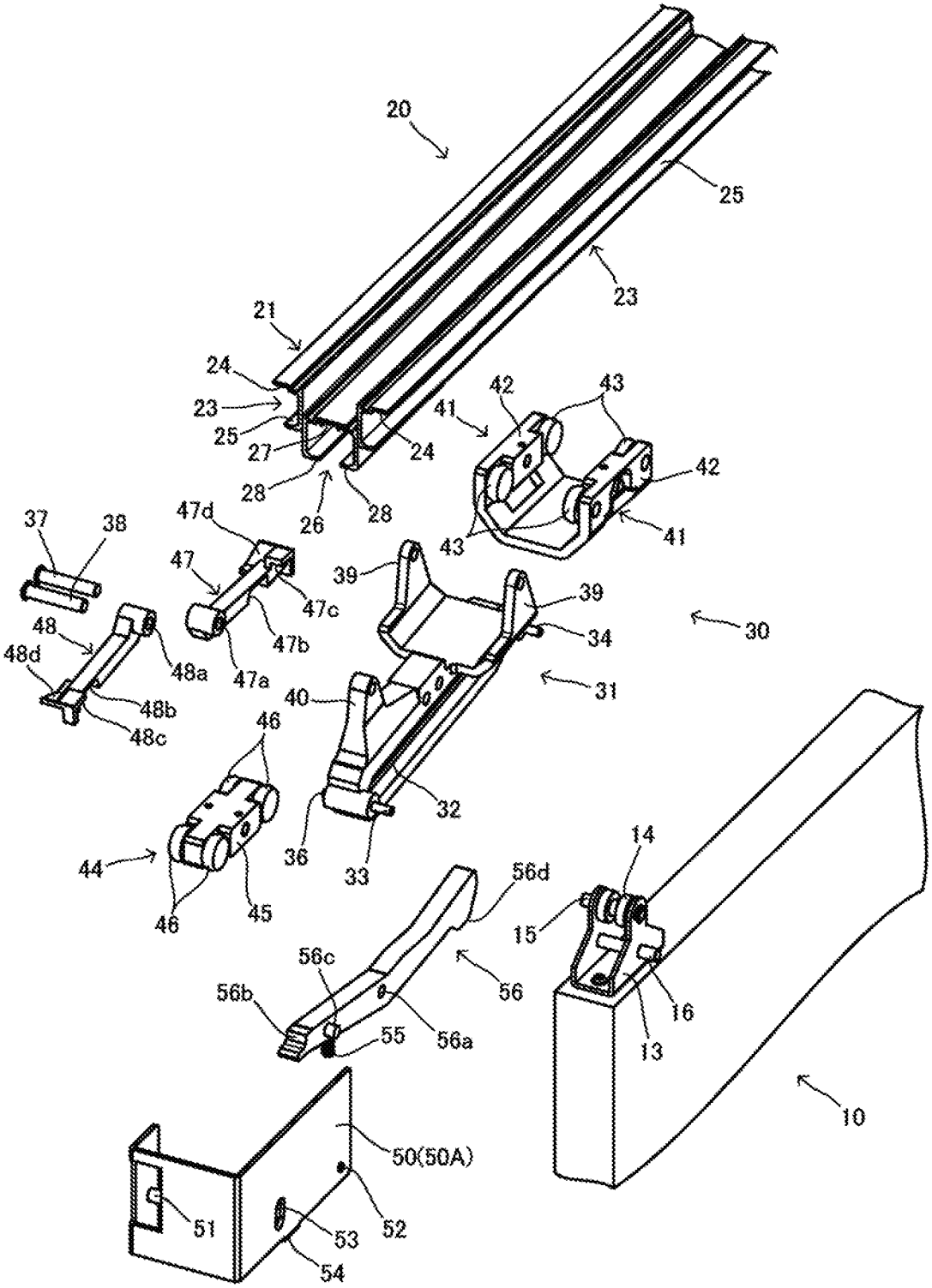
FIG. 4 is an exploded schematic perspective view in which part of the sliding door device is omitted.

In the embodiment, as illustrated in FIGS. 3 and 4, a pair of first rails 23, 23 is provided so as to be located on both sides of the second rail 26 in the width direction. A pair of first runners 41, 41 is provided for the holding member 30 mentioned below so as to be respectively guided by the pair of first rails 23, 23.

The pair of first rails 23, 23 is configured to be respectively provided with guide grooves 24, 24 that open outward in the door thickness direction. The first rails 23, 23 include upper plate portions that define the respective guide grooves 24, 24, side plate portions on inner side of the door thickness direction, and lower plate portions 25, 25; and the first rails 23, 23 are substantially in a C shape, i.e. a U shape, seen from the rail longitudinal direction.

In the embodiment, the upper plate portions of the first rails 23, 23 and the lower plate portions 25, 25 of the first rails 23, 23 are provided in parallel to each other. In other words, the upper plate portions of the first rails 23, 23 and the lower plate portions 25, 25 of the first rails 23, 23 are formed in an inclined shape that becomes downward from the first end portion 21 to the second end portion 22. The first rails 23, 23 are formed in an equable shape over the total length.

A projection dimension along the door thickness direction from the side plate portions of the upper plate portions of the first rails 23, 23 is greater than a projection dimension along the door thickness direction from side plate portions of the lower plate portions 25, 25. The figures illustrate an example in which the projection dimension of the upper plate portions of the first rails 23, 23 is substantially twice as great as the projection dimension of the lower plate portions 25, 25.

Upper faces of the lower plate portions 25, 25 of the first rails 23, 23 become guide faces of the first runners 41, 41 to be mentioned below, i.e. travel faces of rolling elements 43, 43, and are formed in an inclined face shape that becomes downward from the first end portion 21 to the second end portion 22.

The second rail 26 is configured to be provided with a guide groove 27 that opens downward. The second rail 26 includes an upper plate portion, side plate portions on both sides in the door thickness direction, and lower plate portions 28, 28 that project into mutually facing direction from lower ends of both side plate portions. The upper plate portion, the side plate portions on both sides in the door thickness direction, and the lower plate portions 28, 28 defines the guide groove 27. The second rail 26 is substantially in the C shape, i.e. the U shape, seen from the rail longitudinal direction.

In the embodiment, the upper plate portion of the second rail 26 and the lower plate portions 28, 28 of the second rail 26 are provided in parallel to each other. In other words, the upper plate portion of the second rail 26 and the lower plate portions 28, 28 of the second rail 26 are formed in the inclined shape that becomes downward from the second end portion 22 to the first end portion 21. The second rail 26 is formed in the equable shape over the total length. Upper faces of the lower plate portions 28, 28 on both sides of the second rail 26 become guide faces of the second runner 44 to be mentioned below, i.e. travel faces of rolling elements 46, 46, and are formed in an inclined face shape that becomes downward from the second end portion 22 to the first end portion 21.

The rail unit 20 constituted by the first rails 23, 23 and the second rail 26 can be formed by connecting the first rails 23, 23 and the second rail 26 that are respectively in separate members by the bolt, weld, glue, or the like. The first rails 23, 23 and the second rail 26 of the rail units 20 can be formed integrally. A plurality of (two in the embodiment) rail units 20, 20 provided in tandem can be formed integrally.

The above embodiment shows an example in which the upper plate portions of the first rails 23, 23 and the lower plate portions 25, 25 of the first rails 23, 23 are in parallel to each other, and in which the upper plate portion of the second rail 26 and the lower plate portions 28, 28 of the second rail 26 are in parallel to each other, but is not limited to such an aspect. As long as the upper faces of the lower plate portions 25, 25, 28, 28 of the respective rails 23, 23, 26 are in the inclined face shape as mentioned above, at least one of the upper plate portions among the upper plate portions of the first rails 23, 23 and the second rails 26 can be in a horizontal state.

In the embodiment, as illustrated in FIG. 5, the holding member 30 is configured to be arranged with the first runners 41, 41 and the second runner 44 apart from each other in the rail longitudinal direction. The holding member 30 slidably holds the door body 10 in the rail longitudinal direction, and has a switch portion 31 constituting the switch mechanism. By moving the door body 10 relative to the switch portion 31 in the rail longitudinal direction, the holding member 30 is configured to be switched between the state in which the load is applied onto the first runners 41, 41 sides and the state in which the load is applied onto the second runner 44 side. In the embodiment, the first runners 41, 41 and the second runner 44 are arranged in such a manner that a side to which the load is applied becomes a head position when assisted to travel along the respective rails 23, 26. Namely, in the embodiment, the first runners 41, 41 are configured to be provided on the second end portion 22 side in the rail longitudinal direction of the holding member 30, and the second runner 44 is configured to be provided on the first end portion 21 side in the rail longitudinal direction of the holding member 30.

The switch portion 31 constitutes the main body of the holding member and, in the embodiment, is in a hanger shape that holds the door body 10 in a suspending manner. The switch portion 31 is arranged so as to be located substantially above the door body 10. The switch portion 31 is provided with a guide portion 32 with which an engaging portion 14 provided for the door body 10 slidably engages. In the embodiment, the guide portion 32 of the switch portion 31 is in a guide groove shape that opens in the direction along the door thickness direction and extends into the direction along the rail longitudinal direction. The guide portion 32 is in a guide groove shape that penetrates into the direction along the door thickness direction and in a slit shape that extends into the direction along the rail longitudinal direction. Both end portions in the longitudinal direction of the guide portion 32 are substantially in a semicircular shape seen from the direction along the door thickness direction. Opening peripheries on both sides in the door thickness direction of the guide portion 32 are respectively provided with recessed step portions over the whole circumference. In other words, a central part of an inner peripheral portion of the guide portion 32 in the direction along the door thickness direction is configured to be provided with a protrusion stripe portion extending into circumferential direction over the whole circumference.

As illustrated in FIGS. 4 and 5, the engaging portion 14 on a door body 10 side that slidably engages with and is guided by the guide portion 32 is provided on an upper end portion of an end portion in the door width direction, i.e. the door tip side end portion. The engaging portion 14 also functions as a connection portion that connects the holding member 30 and the door body 10. The engaging portion 14 is similarly provided on the door end portion of the door body 10.

In the embodiment, the engaging portion 14 is in a shaft shape, i.e. a columnar shape, in which the axial direction is along the door thickness direction in which the engaging portion 14 is inserted into the guide portion 32 of the switch portion 31 that penetrates in the door thickness direction as above. The engaging portion 14 is configured to be provided with the rolling elements that respectively engage with recessed step portions provided on both sides of the door thickness direction of the guide portion 32 as mentioned above and that travel along a face facing upward of the recessed step portion. Between the rolling elements on both sides of the door thickness direction of the engaging portion 14, a shaft portion that is inserted between upper and lower protrusion stripe portions of the guide portion 32 is provided.

The engaging portion 14 is provided so as to bridge over a pair of connection base portions 13 in a supporting piece shape that are provided so as to protrude upward from the upper end face of the door body 10 and provided apart from each other in the door thickness direction.

The guide portion 32 of the switch portion 31 and the engaging portion 14 of the door body 10 are not limited to such an aspect as mentioned above. For instance, in place of such an aspect in which the guide portion 32 is penetrated in the door thickness direction, the guide portion 32 can be in the guide groove shape that opens on both sides or one side of the door thickness direction. In such a case, the engaging portion 14 of the door body 10 can be configured to be provided with the rolling element that engages with the guide portion 32 on both sides or one side of the door thickness direction. The guide portion 32 can be constituted to be engaged so as to hang the engaging portion 14 of the door body 10. The guide portion 32 of the switch portion 31 and the engaging portion 14 of the door body 10 slidably engaging with the guide portion 32 of the switch portion 31 can be modified in various shapes.

Figure 5A:
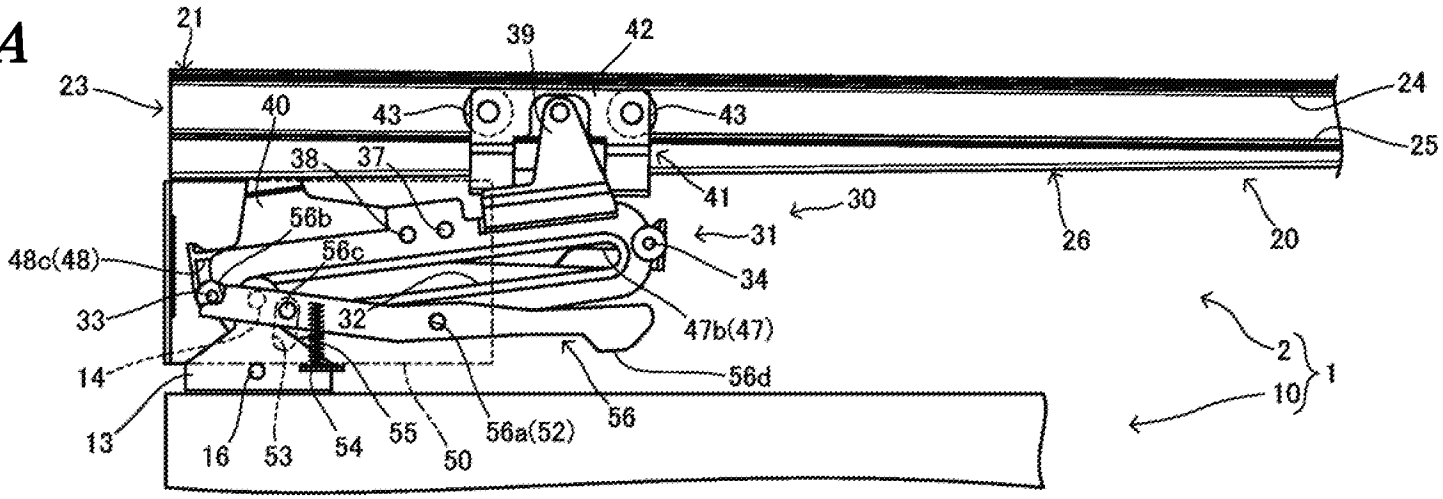
FIG. 5A is a schematic longitudinal sectional view partially broken and corresponding to the direction of the arrows along the line Z1-Z1 in FIG. 3.

As illustrated in FIG. 5A, a pair of first runners 41, 41 is provided so as to be located on an upper side of a region on the second end portion 22 side in the rail longitudinal direction, i.e. one side region in the longitudinal direction of the guide portion 32 of the switch portion 31, and are constituted similarly to each other.

The first runners 41, 41 are rotatable, i.e. swingable, relative to the switch portion 31 around a shaft along the door thickness direction coaxially to each other so as to permit displacement of the switch portion 31 that is displaced as mentioned below. In the embodiment, as illustrated in FIG. 4, the switch portion 31 is configured to be provided with a pair of first connection piece portions 39, 39, apart from each other in the door thickness direction, to which base portions 42, 42 of the first runners 41, 41 are rotatably connected. The first connection piece portions 39, 39 are provided so as to protrude upward and are configured to be rotatably connected to the base portions 42, 42 of the first runners 41, 41 on the upper end portions respectively.

The base portions 42, 42 of the pair of first runners 41, 41 are provided with the rolling elements 43, 43 that roll on the respective lower plate portions 25, 25 of the above-mentioned pair of first rails 23, 23. The rolling elements 43, 43 constitute engaging portions that slidably engage with the first rails 23, 23, and are rotatable around the shaft in which the axial direction is along the door thickness direction. The rolling element 43 of the first runner 41 on one side in the door thickness direction and the rolling element 43 of the first runner 41 on the other side in the door thickness direction are provided coaxially to each other with the same diameter.

As illustrated in FIGS. 3 and 4, the rolling elements 43, 43 are provided on the inner side of the door thickness direction, i.e. on a side in which the base portions 42, 42 face to each other. As illustrated in FIG. 3, the base portions 42, 42 and the first connection piece portions 39, 39 are respectively configured to be inserted into gaps between a groove inside wall of the recessed groove provided for the upper frame 4 and the lower plate portions 25, 25 of the first rails 23, 23.

In the embodiment, the first runners 41, 41 are configured to be respectively provided with a plurality of (two in the figures) rolling elements 43, 43, 43, 43 apart from each other in the rail longitudinal direction. In the figures, the rolling elements 43, 43, 43, 43 are configured to be provided respectively on both sides in the rail longitudinal direction of connection portions between the base portions 42, 42 of the first runners 41, 41 and the first connection piece portions 39, 39.

In the embodiment, the base portions 42, 42 of the first runners 41, 41 are in a connected integral shape. The figures illustrate an example in which the first runners 41, 41 are substantially in the C shape or the U shape that opens upward seen from the rail longitudinal direction so as to receive the second rail 26. Namely, the first runners 41, 41 are configured to be provided with connection portions that connect lower end portions of a pair of base portions 42, 42.

Figure 5B:
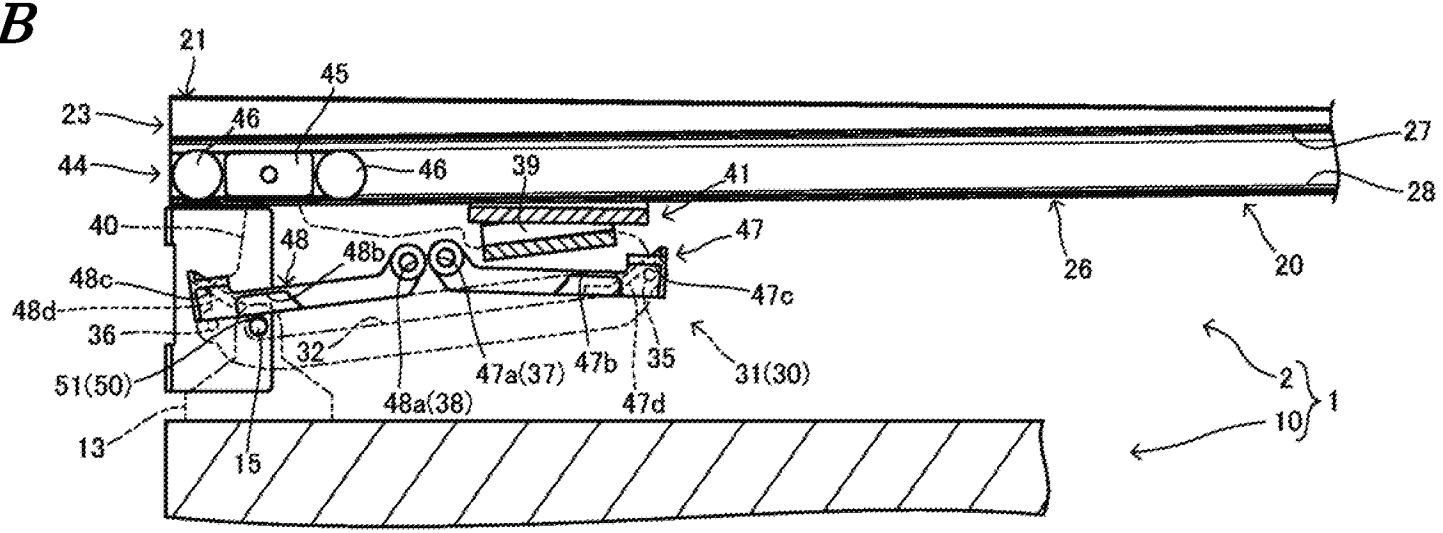
FIG. 5B is a schematic longitudinal sectional view partially broken and corresponding to the direction of the arrows along the line Z2-Z2 in FIG. 3.

As illustrated in FIG. 5B, the second runner 44 is provided so as to be located on an upper side of a region on the first end portion 21 side in the rail longitudinal direction, i.e. a region on the other side in the longitudinal direction of the guide portion 32 of the switch portion 31.

The second runner 44 is rotatable or swingable relative to the switch portion 31 around the shaft along the door thickness direction so as to permit the displacement of the switch portion 31 when it is displaced as mentioned below. In the embodiment, as illustrated in FIG. 4, the switch portion 31 is configured to be provided with a second connection piece portion 40 to which a base portion 45 of the second runner 44 is rotatably connected. The second connection piece portion 40 is provided so as to protrude upward and configured to be rotatably connected to the base portion 45 of the second runner 44 on an upper end portion of the second connection piece portion 40. As illustrated in FIG. 3, the second connection piece portion 40 is configured to be inserted into a gap between the lower plate portions 28, 28 on both sides of the second rail 26.

The rolling elements 46, 46 rolling on the lower plate portions 28, 28 on both sides of the second rail 26 as mentioned above are provided on both sides in the door thickness direction of the base portion 45 of the second runner 44. The rolling elements 46, 46 constitute engaging portions that slidably engage with the second rail 26 and are rotatable around the shaft in which the axial direction is along the door thickness direction. The rolling element 46 on one side in the door thickness direction of the base portion 45 and the rolling element 46 on the other side in the door thickness direction of the base portion 45 are provided coaxially to each other with the same diameter.

In the embodiment, a plurality of (two in the figures) rolling elements 46, 46, 46, 46 are configured to be provided apart from each other in the rail longitudinal direction on the respective both sides in the door thickness direction of the base portion 45 of the second runner 44. In the figures, the rolling elements 46, 46, 46, 46 are configured to be provided respectively on both sides in the rail longitudinal direction of a connection portion between the base portion 45 of the second runner 44 and the second connection piece portion 40.

The respective rolling elements 46 of the second runner 44 and the respective rolling elements 43 of the first runner 41, having the same diameter, are configured in such a manner that respective shaft centers are located at the same height when the longitudinal direction of the guide portion 32 of the switch portion 31 that is displaced as mentioned below is substantially along the horizontal direction.

As illustrated in FIGS. 5 and 9, the guide portion 32 of the switch portion 31, in which the first runners 41, 41 and the second runner 44 are arranged apart from each other in the rail longitudinal direction, becomes an inclined state when provided on both end portions 21, 22 in the longitudinal direction of the rail unit 20.

In other words, as illustrated in FIG. 5, in such a state in which the holding member 30 is located at the first end portion 21 of the rail unit 20, the rolling element 43 of the first runner 41 is located in the vicinity of the highest region (the head of a slope) of the lower plate portion 25 of the first rail 23 and the rolling element 46 of the second runner 44 is located in the vicinity of the lowest region (the foot of the slope) of the lower plate portion 28 of the second rail 26. In such a position, the guide portion 32 becomes the inclined state, i.e. an upward slope state, upward from the second runner 44 side into the first runner 41 side by a difference in height between the lower plate portion 25 of the first rail 23 with which the first runner 41 engages and the lower plate portion 28 of the second rail 26 with which the second runner 44 engages.

As illustrated in FIG. 9, in such a state in which the holding member 30 is located at the second end portion 22 of the rail unit 20, the rolling element 43 of the first runner 41 is located in the vicinity of the lowest region (the foot of the slope) of the lower plate portion 25 of the first rail 23 and the rolling element 46 of the second runner 44 is located in the vicinity of the highest position (the head of the slope) of the lower plate portion 28 of the second rail 26. In such a position, the guide portion 32 becomes the inclined state, i.e. the upward slope state, upward from the first runner 41 side into the second runner 44 side by the difference in height between the lower plate portion 25 of the first rail 23 with which the first runner 41 engages and the lower plate portion 28 of the second rail 26 with which the second runner 44 engages.

In such a state in which the holding member 30 is located at a central part in the longitudinal direction of the rail unit 20, the lower plate portion 25 of the first rail 23 and the lower plate portion 28 of the second rail 26 become substantially the same height and the guide portion 32 becomes the substantially horizontal state in which the longitudinal direction is substantially along the horizontal direction (not illustrated in the figures).

By moving the engaging portion 14 of the door body 10 relative to the guide portion 32, a load of the door body 10 is able to be switched so as to be mainly applied on either one of the first runner 41 or the second runner 44, thereby the travelling of the door body 10 is assisted. Namely, as illustrated in FIGS. 1A and 5, in such a state in which the door body 10 is at the closed position and the engaging portion 14 is located on the second runner 44 side of the guide portion 32, the load of the door body 10 is mainly applied to the second runner 44 than the first runner 41. In the closed position, because the second rail 26 with which the second runner 44 engages is inclined downward into the first end portion 21, the door body 10 is assisted so as to move into the first end portion 21 side but such movement is suppressed by the door tip side longitudinal frame 5 or an appropriate stopper.

When the door body 10 at the closed position as mentioned above is moved relative to the guide portion 32 of the switch portion 31 from the first end portion 21 side into the second end portion 22 side, the load of the door body 10 is switched to be applied onto the first runner 41 side in such a manner that the center of gravity of the holding member 30 that holds the door body 10 moves. In other words, when the engaging portion 14 of the door body 10 is located on the first runner 41 side of the guide portion 32, the load of the door body 10 is mainly applied onto the first runner 41 than the second runner 42.

Namely, as illustrated in FIGS. 5 to 8, the switch portion 31 is configured to be switched into the state in which the load is applied onto the first runner 41 side by moving the door body 10 so that the guide portion 32 goes upward in the inclined state upward from the second runner 44 side to the first runner 41 side.

When the load of the door body 10 is applied onto the first runner 41 side as mentioned above, the first runner 41 slides downward the first rail 23 in the downward slope state toward the second end portion 22, thereby the door body 10 is assisted toward the second end portion 22 side, i.e. the opening side, by the load. In such a state in which the load is applied onto the first runner 41 side and the travelling is assisted downward the first rail 23, the first runner 41 becomes the head position.

Figure 1B:
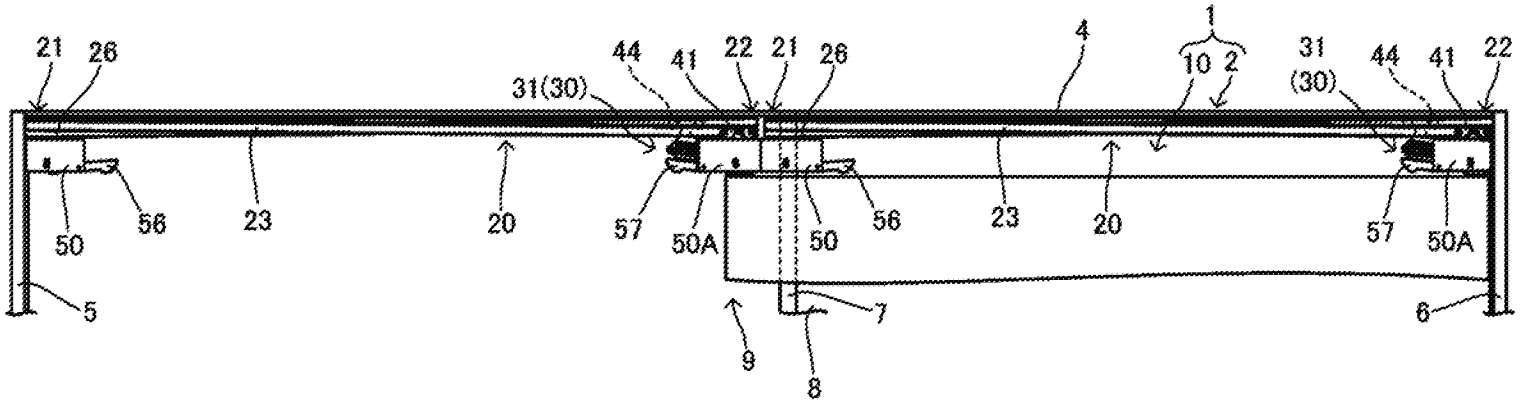

As illustrated in FIGS. 1B and 9, in such a state that the load is applied onto the first runner 41 side, when the door body 10 is at the fully open position, the door body 10 is assisted so as to move to the second end portion 22 side but such movement is suppressed by the door end side longitudinal frame 6 or the appropriate stopper.

Contrary to the above, when the door body 10 at the fully open position as mentioned above is moved relative to the guide portion 32 of the switch portion 31 from the second end portion 22 side to the first end portion 21 side, the load of the door body 10 is switched to be applied onto the second runner 44 side in such a manner that the center of gravity of the holding member 30 that holds the door body 10 moves. Namely, as illustrated in FIG. 9, the switch portion 31 is configured to be switched into the state in which the load is applied onto the second runner 44 side by moving the door body 10 so that the guide portion 32 goes upward in the inclined state upward from the first runner 41 side to the second runner 44 side.

When the load of the door body 10 is applied onto the second runner 44 side, the second runner 44 slides downward the second rail 26 in the downward slope state toward the first end portion 21, thereby the door body 10 is assisted toward the first end portion 21 side, i.e. the closing side, by the load. In such a state in which the load is applied onto the second runner 44 side and the travelling is assisted downward the second rail 26, the second runner 44 becomes the head position.

Namely, in the embodiment, the door body 10 located at an initial position, i.e. either one of the closed position or the fully open position, is configured to move upward the guide portion 32 to the other side along the guide portion 32 and the travelling of the door body 10 is configured to be assisted by using potential energy.

A dimension along the rail longitudinal direction of the guide portion 32 as mentioned above can be appropriately set in view of shortening a movement distance, an initial operation stroke, of the door body 10 that is required for assisting or in accordance with the door width dimension, or the like. An inclined angle or an initial inclined angle of the guide portion 32 at the closed position or the fully open position relative to a horizontal face and inclined angles or inclined angles of the rails of the lower plate portions 25, 28 of the respective rails 23, 26 relative to the horizontal face can be appropriately set in view of the above or in accordance with such as an assist degree that the door body 10 requires, weight of the door body 10, and frictional resistance of the respective rails 23, 26, or the like.

If the dimension along the rail longitudinal direction of the guide portion 32 is set greater, the initial inclined angle becomes smaller and necessary power for operation also becomes smaller but the initial operation stroke tends to be greater. On the other hand, if the dimension along the rail longitudinal direction of the guide portion 32 is set shorter, the initial operation stroke becomes smaller but the initial inclined angle becomes greater and the necessary power for operation tends to be greater.

From the above-mentioned viewpoint, the dimension along the rail longitudinal direction of the guide portion 32 can be less than one half of the door width dimension, can also be from one third to one twentieth of the door width dimension, or preferably can be from one fifth to one tenth of the door width dimension. For instance, the dimension along the rail longitudinal direction of the guide portion 32 can be such that the initial operation stroke is from 50 mm to 200 mm.

The initial inclined angle and the inclined angles of the rails can be appropriately set in accordance with the weight of the door body 10, the frictional resistance of the respective rails 23, 26, or the like so that the door body 10 that is lifted up to a position so as to be assisted travels itself by the load without requiring external force. For instance, from a viewpoint of reducing operation force at the time of initial operation, the initial inclined angle can be from two to twenty degrees, preferably from two to ten degrees, or from two to seven degrees. The inclined angles of the respective rails 23, 26 can be set in accordance with the initial inclined angle of the guide portion 32, the door width dimension of the door body 10, or the like, and can be smaller than the initial inclined angle.

The above-mentioned initial operation stroke and the initial inclined angle can be appropriately set so that a displacement amount in the vertical direction of the door body 10 that is lifted up from the initial position to the position so as to be assisted is from 5 mm to 30 mm, preferably from 5 mm to 20 mm, or from 5 mm to 10 mm.

In the embodiment, the travel assistance device 2 includes a first locking mechanism 56 that suppresses movement of the switch portion 31 when the door body 10 is configured to be moved into the state in which the load is applied onto the first runner 41 side in an unlockable manner. The travel assistance device 2 further includes a second locking mechanism 57 that suppresses the movement of the switch portion 31 when the door body 10 is configured to be moved into the state in which the load is applied onto the second runner 44 side. The travel assistance device 2 further includes a third locking mechanism 47 that maintains the state in which the load is applied onto the first runner 41 side in the unlockable manner, and a fourth locking mechanism 48 that maintains the state in which the load is applied onto the second runner 44 side.

Namely, in the embodiment, the first locking mechanism 56 and the second locking mechanism 57 are configured to suppress, in the unlockable manner, the movement of the switch portion 31 into the other side in the state in which the door body 10 is at the initial position, i.e. either one of the closed position or the fully open position. The third locking mechanism 47 and the fourth locking mechanism 48 are configured to maintain, in the unlockable manner, the state switched so as to move the center of gravity of the holding member 30 that holds the door body 10.

In the embodiment, in a state in which the movement of the switch portion 31 is suppressed by the first locking mechanism 56, when the door body 10 is moved relative to the switch portion 31 into the state in which the load is applied onto the first runner 41 side, the third locking mechanism 47 is configured to be in a locked state and the first locking mechanism 56 is configured to be unlocked. In the embodiment, when the door body 10 is further moved slightly after the third locking mechanism 47 is set in the locked state, the first locking mechanism 56 is configured to be unlocked.

When the first locking mechanism 56 is unlocked and the door body 10 is further moved in such a manner that the switch portion 31 is at a position where the movement of the switch portion 31 is suppressed by the second locking mechanism 57, the third locking mechanism 47 is configured to be unlocked.

On the other hand, in a state in which the movement of the switch portion 31 is suppressed by the second locking mechanism 57, when the door body 10 is moved relative to the switch portion 31 into the state in which the load is applied onto the second runner 44 side, the fourth locking mechanism 48 is configured to be in the locked state and the second locking mechanism 57 is configured to be unlocked. In the embodiment, when the door body 10 is further moved slightly after the fourth locking mechanism 48 is set in the locked state, the second locking mechanism 57 is configured to be unlocked.

When the second locking mechanism 57 is unlocked and the door body 10 is further moved in such a manner that the switch portion 31 is at a position where the movement of the switch portion 31 is suppressed by the first locking mechanism 56, the fourth locking mechanism 48 is configured to be unlocked.

In the embodiment, the locking mechanisms 56, 57, 47, 48 are respectively configured to be locked or unlocked in accordance with movement of the door body 10.

As illustrated in FIG. 1, in the embodiment, the first locking mechanism 56 and the second locking mechanism 57 are respectively provided on the first end portion 21 side and the second end portion 22 side of the rail unit 20.

Figure 9A:
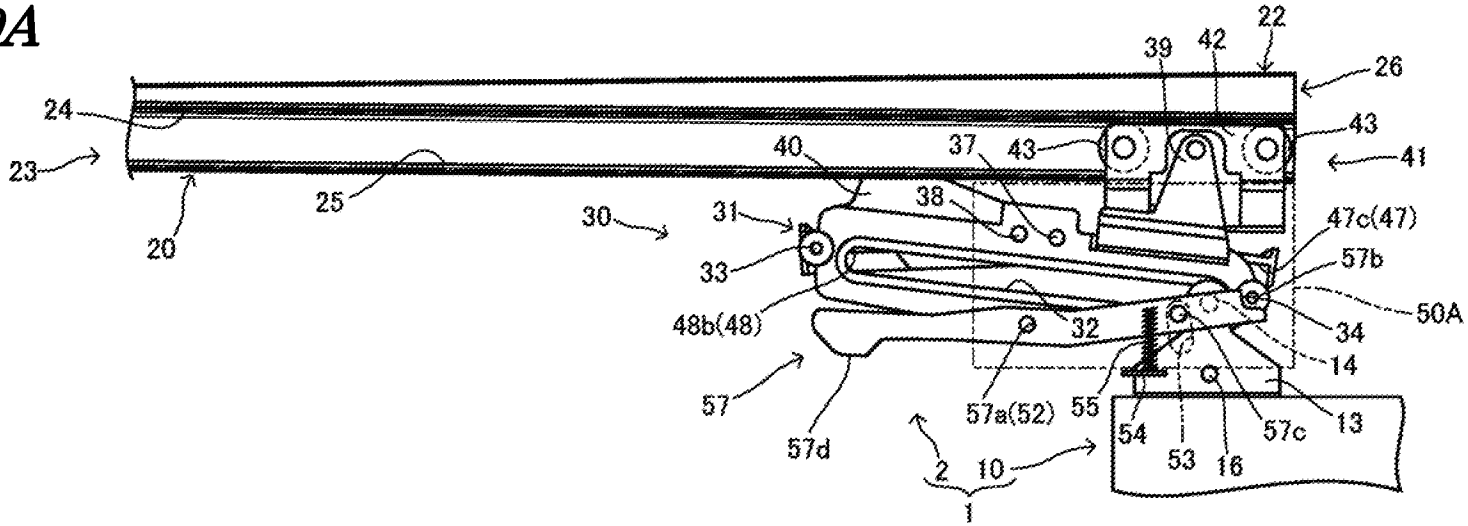
FIG. 9A is a schematic longitudinal sectional view partially broken and corresponding to FIG. 5A.

As illustrated in FIG. 5A and FIG. 9A, the first locking mechanism 56 and the second locking mechanism 57 are provided with locking portions 56*b*, 57*b* that suppress the movement of the switch portion 31 by engaging with locked portions 33, 34 provided for the switch portion 31 (the holding member 30). The door body 10 is provided with an unlocking portion 16 that unlocks engagement of the locking portions 56*b*, 57*b* of the first locking mechanism 56 and the second locking mechanism 57 relative to the locked portions 33, 34 of the switch portion 31.

The first locking portion 56 and the second locking portion 57 are respectively provided at a first lock unit 50 and a second lock unit 50A that are respectively fixed to the end portions 21, 22 in the longitudinal direction of the rail unit 20, the door frames 4, 5(6), 7, a framework (a mounting substrate), or the like.

The first lock unit 50 provided on the first end portion 21 side and the second lock unit 50A provided on the second end portion 22 side are formed in a symmetrical shape, i.e. a linearly symmetric shape in which a center line in the longitudinal direction of the rail unit 20 is a symmetric axis, including the locking mechanisms 56, 57 provided for the first lock unit 50 and the second lock unit 50A.

In the embodiment, the first locking mechanism 56 and the second locking mechanism 57 are respectively arranged as a first locking lever 56 and a second locking lever 57 that are formed in a lever shape and are rotatably held around shafts 52, 52 along the door thickness direction relative to the lock units 50, 50A.

The first locking lever 56 and the second locking lever 57 are arranged so as to be located on one side in the door thickness direction of the switch portion 31. The first locking lever 56 and the second locking lever 57 are long in the rail longitudinal direction and are substantially similar to the switch portion 31 in length.

The first locking lever 56 is configured in such a manner that an end portion on the first end portion 21 side is provided with the locking portion 56*b*, and an end portion on the second end portion 22 side is provided with an unlocked portion 56*d* that is unlocked by the unlocking portion 16 of the door body 10. In the embodiment, as illustrated in FIG. 4 and FIG. 5A, the locking portion 56*b* is in a recessed step that is arranged in a notched shape so as to open upward and toward the first end portion 21 side, i.e. an outer side in the longitudinal direction of the first locking lever 56. The unlocked portion 56*d* is formed in a convex shape that projects downward and tapers off downward seen from the door thickness direction. Namely, both side faces in the rail longitudinal direction of the unlocked portion 56*d* are inclined faces that incline in a direction being close to each other as going downward.

The first locking lever 56 is configured to be provided with a bearing hole 56*a* that is a rotation center on a middle region in the longitudinal direction (in the figures, a substantially central part in the longitudinal direction). The first lock unit 50 is provided with a shaft portion 52 that is inserted into the bearing hole 56*a*. The first lock unit 50 can be configured to be provided with the bearing hole, and the first locking lever 56 can be provided with the shaft portion.

The first lock unit 50 is provided with an energization member 55 that energizes the first locking lever 56 toward a lock side. In the figures, the energization member 55 is a compression coil spring that is held by a spring holding portion 54 of the first lock unit 50 so as to energize upward a region on a locking portion 56*b* side further than the bearing hole 56*a*. The first lock unit 50 is provided with a regulation portion 53 that regulates rotation of the first locking lever 56. In the embodiment, the regulation portion 53 is in a long hole shape being vertically long in diameter and receives a pin-shaped regulated portion 56*c* that is provided on the region on the locking portion 56*b* side further than the bearing hole 56*a* of the first locking lever 56 so as to project toward one side in the door thickness direction. The regulation portion 53 is configured to suppress further rotation toward the lock side of the first locking lever 56 that is energized by the energization member 55. The spring holding portion 54, the regulation portion 53, and the shaft portion 52 are provided on a plate shaped portion of the first lock unit 50 that is provided on one side in the door thickness direction of the first locking lever 56.

As illustrated in FIG. 9A, the second locking lever 57 is configured so as to horizontally invert the first locking lever 56. Namely, the second locking lever 57 is configured in such a manner that an end portion on the second end portion 22 side is provided with a locking portion 57*b* in the recessed step the same as above, and an end portion on the first end portion 21 side is provided with an unlocked portion 57*d* that is unlocked by the unlocking portion 16 of the door body 10 and is in the convex shape the same as above. A middle region in the longitudinal direction of the second locking lever 57 (in the figures, a substantially central part in the longitudinal direction) is provided with a bearing hole 57*a* into which the shaft portion 52 the same as above that is provided for the second lock unit 50A is inserted. Similar to the above, the second lock unit 50A can be provided with the bearing hole, and the second locking lever 57 can be provided with the shaft portion.

The second lock unit 50A is provided with the energization member 55 that energizes the second locking lever 57 toward the lock side the same as above and is provided with the spring holding portion 54 that holds the energization member 55.

The second lock unit 50A is provided with the regulation portion 53 similar to the above that receives a regulated portion 57*c* similar to the above that is provided for the second locking lever 57.

The switch portion 31 of the holding member 30 is provided with the first locked portion 33 that engages with the locking portion 56*b* of the first locking lever 56 and the second locked portion 34 that engages with the locking portion 57*b* of the second locking lever 57. The first locked portion 33 and the second locked portion 34 are provided in pairs so as to be located on both sides in the longitudinal direction of the guide portion 32 of the switch portion 31. The first locked portion 33 is provided at an end portion on the first end portion 21 side of the switch portion 31 and the second locked portion 34 is provided at an end portion on the second end portion 22 side of the switch portion 31. In the embodiment, as illustrated in FIG. 4, the first locked portion 33 and the second locked portion 34 are in a pin shape that projects toward one side in the door thickness direction.

As illustrated in FIG. 4, the unlocking portion 16 provided for the door body 10 is in the pin shape that projects toward one side in the door thickness direction. In the embodiment, the unlocking portion 16 is used both for unlocking the first locking lever 56 and for unlocking the second locking lever 57.

The unlocking portion 16 is configured to abut on the unlocked portions 56*d*, 57*d* so as to rotate the first locking lever 56 and the second locking lever 57 toward an unlocked side.

The unlocking portion 16 is provided for the connection base portion 13 that is provided on the upper end portion of the end portion in the door width direction, i.e. the door tip side end portion, of the door body 10. Seen from the door thickness direction, the unlocking portion 16 is configured to be provided so as to be located substantially immediately below the engaging portion 14 that is in the shaft shape and is provided for the connection base portion 13. The door end portion of the door body 10 is similarly provided with the unlocking portion 16.

In place of such an aspect in which the door body 10 is provided with the unlocking portion 16 that is used both for unlocking the first locking lever 56 and for unlocking the second locking lever 57, the aspect can be such that an unlocking portion that unlocks the first locking lever 56 and an unlocking portion that unlocks the second locking lever 57 are provided. For instance, the aspect can be such that the unlocking portion that unlocks the first locking lever 56 is provided on one side in the door width direction of the engaging portion 14 and the unlocking portion that unlocks the second locking lever 57 is provided on the other side in the door width direction of the engaging portion 14. In such a case, length or the like of the first locking lever 56 and the second locking lever 57 can be appropriately changed. The unlocking portion 16 of the door body 10, the locked portions 33, 34 of the switch portion 31, the first locking mechanism (lever) 56 and the second locking mechanism (lever) 57 are not limited to the above embodiment and are able to be modified in various shapes.

As illustrated in FIG. 4 and FIG. 5B, the third locking mechanism 47 and the fourth locking mechanism 48 are provided for the switch portion 31.

The third locking mechanism 47 and the fourth locking mechanism 48 are provided with locking portions 47*b*, 48*b* that engage with a locked portion 15 provided for the door body 10 and maintain a load switched state, i.e. the state in which the load is applied onto the first runner 41 side or the second runner 44 side. Unlocking portions 51, 51A that unlock engagement of the locking portions 47*b*, 48*b* of the third locking mechanism 47 and the fourth locking mechanism 48 relative to the locked portion 15 of the door body 10 are respectively provided on the first end portion 21 side and the second end portion 22 side of the rail unit 20. The third locking mechanism 47 provided on the second end portion 22 side of the switch portion 31 and the fourth locking mechanism 48 provided on the first end portion 21 side of the switch portion 31 are formed in the symmetrical shape, i.e. the linearly symmetric shape in which the center line in the longitudinal direction of the guide portion 32 of the switch portion 31 is the symmetric axis.

In the embodiment, the third locking mechanism 47 and the fourth locking mechanism 48 are respectively arranged as a third locking lever 47 and a fourth locking lever 48 that are formed in a lever shape and are rotatably held around shafts 37, 38 along the door thickness direction relative to the switch portion 31.

The third locking lever 47 and the fourth locking lever 48 are provided on the other side in the door thickness direction of the switch portion 31 and are long in the longitudinal direction of the guide portion 32. End portions on close sides in the longitudinal direction of the third locking lever 47 and the fourth locking lever 48 are provided with bearing holes 47*a*, 48*a* into which lock shafts 37, 38 provided in pairs on an upward side region of a central part in the longitudinal direction of the guide portion 32 are inserted. The lock shaft 37 of the third locking lever 47 is provided on the second end portion 22 side further than a central line in the longitudinal direction of the guide portion 32, and the lock shaft 38 of the fourth locking lever 48 is provided on the first end portion 21 side further than the central line in the longitudinal direction of the guide portion 32. The aspect can be such that the third locking lever 47 and the fourth locking lever 48 are provided with the shaft portions and the switch portion 31 is provided with the bearing hole.

The third locking lever 47 and the fourth locking lever 48 are configured in such a manner that the locking portions 47*b*, 48*b* are provided in a middle region in the longitudinal direction and unlocked portions 47*d*, 48*d* that are unlocked by the unlocking portions 51A, 51 are provided at end portions on remote sides in the longitudinal direction, i.e. free end portions. In the embodiment, the locking portions 47*b*, 48*b* are in the recessed shape that is arranged in the notched shape so as to open downward and toward one side in the door thickness direction. The embodiment shows an example in which the locking portions 47*b*, 48*b* are long in the longitudinal direction of the third locking lever 47 and the fourth locking lever 48, and are divided by a face facing one side in the door thickness direction, a face facing downward, and a face substantially along the longitudinal direction. In the locked state, the locking portions 47*b*, 48*b* are formed in such a manner that the first locking lever 56 or the second locking lever 57 is able to be unlocked and the door body 10 is able to move slightly in the rail longitudinal direction relative to the switch portion 31 (the holding member 30). A movable distance of the door body 10 relative to the switch portion 31 in the locked state of the locking portions 47*b*, 48*b* can be appropriately set or can be, for instance, from 5 mm to 20 mm so as to unlock the first locking lever 56 or the second locking lever 57 in such a state in which the locking portions 47*b*, 48*b* are locked.

Figure 9B:
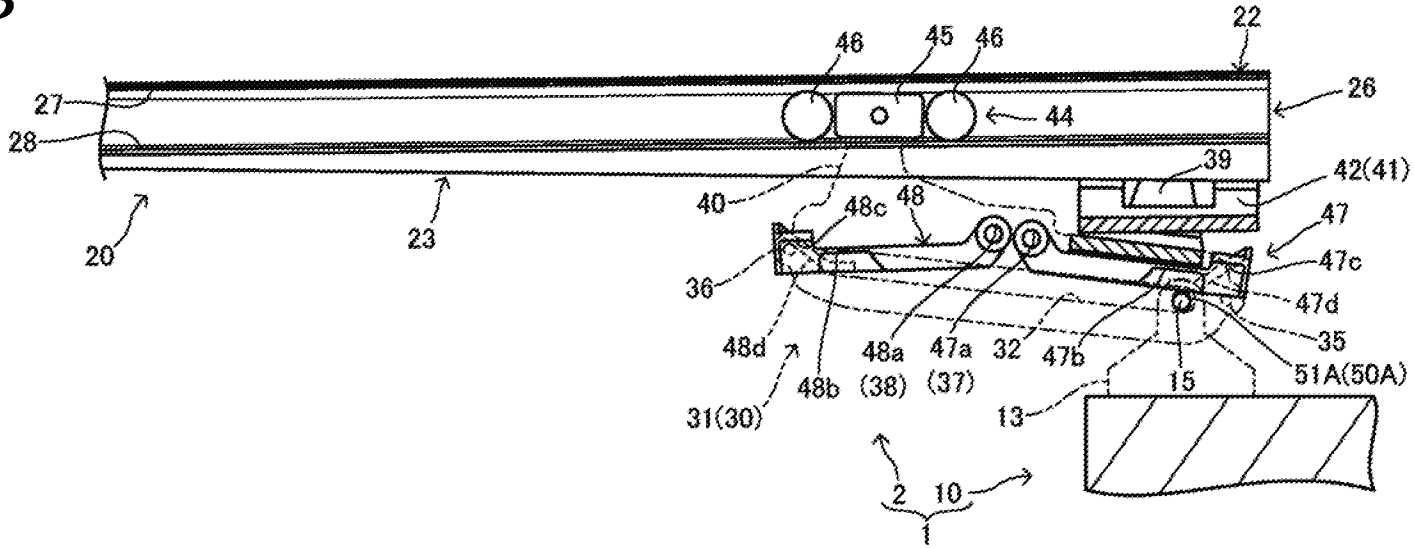
FIG. 9B is a schematic longitudinal sectional view partially broken and corresponding to FIG. 5B.

As illustrated in FIGS. 5B and 9B, the locking portions 47*b*, 48*b* are configured to be able to respectively overlap both end portions in the longitudinal direction of the guide portion 32 seen from the door thickness direction.

The unlocked portions 47*d*, 48*d* are in a protruded piece shape that protrudes toward the other side of the third locking lever 47 and the fourth locking lever 48 in the door thickness direction. The unlocked portions 47*d*, 48*d* are configured to include flat piece portions that are respectively parallel to the longitudinal direction of the locking levers 47, 48 and inclined piece portions that are in an inclined shape so as to mutually rise toward remote sides from the flat piece portions. The flat piece portions of the unlocked portions 47*d*, 48*d* are respectively provided so as to be located at positions overlapping with the locking portions 47*b*, 48*b* seen from the door thickness direction.

Not illustrated in the figures, the switch portion 31 is provided with energization members that energize the third locking lever 47 and the fourth locking lever 48 toward the lock side. The energization members of the third locking lever 47 and the fourth locking lever 48 can be members that energize free end portion sides of the third locking lever 47 and the fourth locking lever 48 downward or can be, for instance, torsion springs provided around the lock shafts 37, 38 or appropriate coil springs.

The switch portion 31 is provided with stopper portions 35, 36 that suppress further rotation of the third locking lever 47 and the fourth locking lever 48 that are energized by the energization members toward the lock side. In the embodiment, the third lock stopper portion 35 that suppresses rotation of the third locking lever 47 and the fourth lock stopper portion 36 that suppresses rotation of the fourth locking lever 48 are provided in pairs so as to be located on both sides of the guide portion 32 in the longitudinal direction. The third lock stopper portion 35 and the fourth lock stopper portion 36 are in the pin shape that protrudes toward the other side in the door thickness direction, referring to FIG. 4. The third lock stopper portion 35 is configured to be provided substantially coaxially to the second locked portion 34 provided at the end portion on the second end portion 22 side of the switch portion 31, and the fourth lock stopper portion 36 is configured to be provided substantially coaxially to the first locked portion 33 provided at the end portion on the first end portion 21 side of the switch portion 31.

The third locking lever 47 and the fourth locking lever 48 are provided with abutting piece portions 47*c*, 48*c* that are abutted by the third lock stopper portion 35 and the fourth lock stopper portion 36. The abutting piece portions 47*c*, 48*c* are provided at the free end portions of the third locking lever 47 and the fourth locking lever 48 so as to protrude toward one side in the door thickness direction.

The third locking lever 47 and the fourth locking lever 48 can be energized by own weight of the third locking lever 47 and the fourth locking lever 48 toward the lock side without the energization members that energize the third locking lever 47 and the fourth locking lever 48 toward the lock side.

As illustrated in FIG. 4, the locked portion 15 of the door body 10 that is locked by the third locking lever 47 and the fourth locking lever 48 protrudes toward the other side in the door thickness direction and is in the pin shape that is inserted into the locking portions 47*b*, 48*b* in the recessed step. In the embodiment, the locked portion 15 is used to be locked respectively by the third locking lever 47 and the fourth locking lever 48. The locked portion 15 is provided at the connection base portion 13 that is provided on the upper end portion of the end portion in the door width direction, i.e. the door tip side end portion, of the door body 10. The locked portion 15 is configured to be provided substantially coaxially to the engaging portion 14 that is in the shaft shape and is provided for the connection base portion 13. The locked portion 15 is similarly provided on the door end portion of the door body 10.

The unlocking portions 51A, 51 that unlock the third locking lever 47 and the fourth locking lever 48 are in the pin shape in which shaft direction is along the door thickness direction. In the embodiment, as illustrated in FIG. 9B, the third unlocking portion 51A that unlocks the third locking lever 47 is provided for the second lock unit 50A. As illustrated in FIG. 5B, the fourth unlocking portion 51 that unlocks the fourth locking lever 48 is provided for the first lock unit 50. The third unlocking portion 51A and the fourth unlocking portion 51 are provided so as to protrude toward one side in the door thickness direction, referring to FIG. 4, on plate shaped portions on the other side in the door thickness direction of the respective lock units 50A, 50 that are provided so as to be located on the other side in the door thickness direction of the third locking lever 47 and the fourth locking lever 48.

The above embodiment shows an example in which the locked portion 15 of the door body 10 is locked respectively by the third locking lever 47 and the fourth locking lever 48, but a pair of locked portions 15 can be configured to be provided separately. The locked portion 15 of the door body 10, the unlocking portions 51, 51A that are respectively provided on the first end portion 21 side and the second end portion 22 side of the rail unit 20, the third locking mechanism (lever) 47 and the fourth locking mechanism (lever) 48 are not limited to the above embodiment and are able to be modified in various shapes.

An example of opening or closing operation of the door body 10 of the sliding door device 1 configured as above is explained below with reference to FIGS. 5 to 9.

As illustrated in FIG. 5A, the holding member 30 located on the first end portion 21 side of the rail unit 20 when the door body 10 is at the closed position is in a state in which movement toward the second end portion 22 side of the rail unit 20 is suppressed by the first locking lever 56. Namely, the holding member 30 is in a state in which the first locked portion 33 of the switch portion 31 engages so as to be received by the locking portion 56*b* of the first locking lever 56 and movement toward the second end portion 22 side is suppressed.

As illustrated in FIG. 5B, the door body 10 at the closed position is in a movable state in which the load is applied onto the first runner 41 side along the guide portion 32 relative to the switch portion 31 of the holding member 30 in which movement toward the second end portion 22 side is suppressed as mentioned above. Namely, when the door body 10 is at the closed position, the flat piece portion of the unlocked portion 48*d* of the fourth locking lever 48 is held so as to run onto the fourth unlocking portion 51 of the first lock unit 50, and the locking portion 48*b* is located on the upper side of the locked portion 15 of the door body 10 and becomes the unlocked state. In the unlocked state in which the fourth locking lever 48 is released as mentioned above, when the door body 10 is at the closed position, because the guide potion 32 is in the upward slope state from the second runner 44 side toward the first runner 41 side, the load is maintained to be applied onto the second runner 44 side. In such a state, the abutting piece portion 47*c* of the third locking lever 47 is held by abutting on the third lock stopper portion 35 of the switch portion 31 and the locking portion 47*b* is located so as to overlap an end portion on the second end portion 22 side of the guide portion 32 seen from the door thickness direction and is in an lockable state.

Figure 6A:
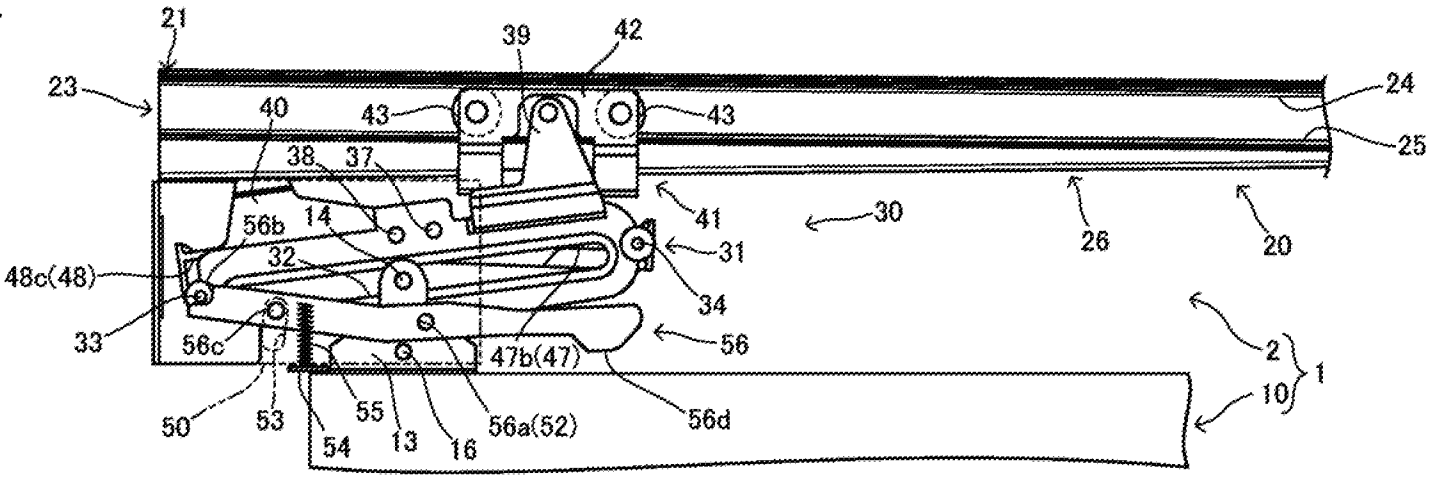
FIG. 6A is a schematic longitudinal sectional view partially broken and corresponding to FIG. 5A.
Figure 6B:
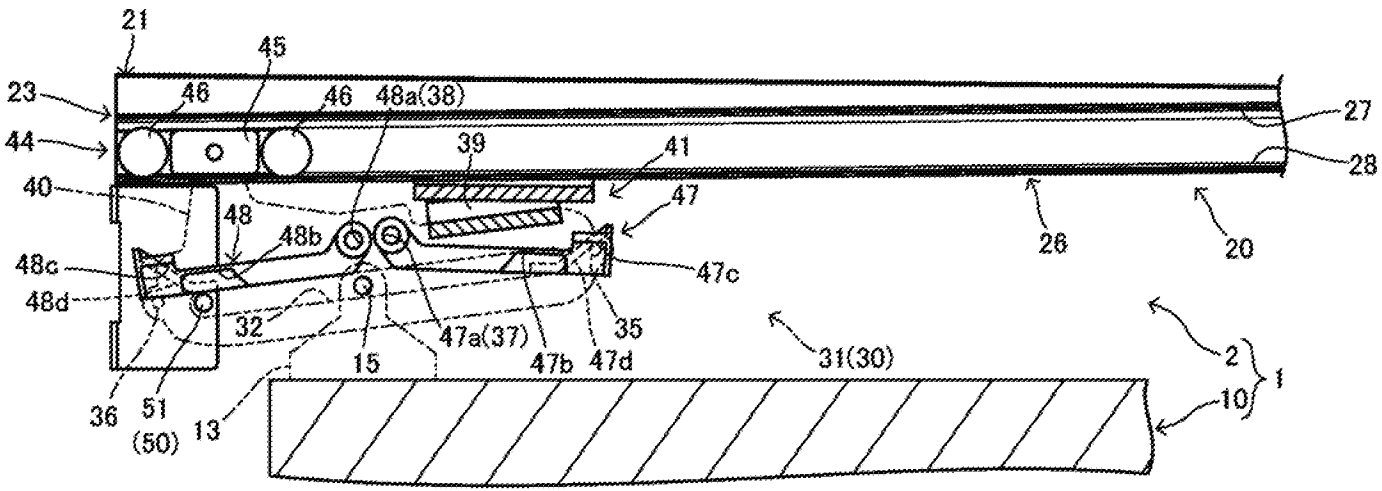
FIG. 6B is a schematic longitudinal sectional view partially broken and corresponding to FIG. 5B.

As mentioned above, when the door body 10 at the closed position is moved toward the opening side, the unlocking portion 16 of the door body 10 moves while being close to or abutting along a downward side of the first locking lever 56 as illustrated in FIGS. 5A and 6A. As illustrated in FIGS. 5B and 6B, the locked portion 15 of the door body 10 moves while being close to or abutting along downward sides of the fourth locking lever 48 and the third locking lever 47. In such a case, the locked portion 15 of the door body 10 moves so as to resist energization of the energization member of the third locking lever 47 and push up the free end portion side of the third locking lever 47 in the lockable state. As illustrated in FIG. 7B, when the locked portion 15 of the door body 10 reaches the lock portion 47*b* of the third locking lever 47, the third locking lever 47 energized by the energization member rotates toward the lock side, the locked portion 15 engages with the lock portion 47*b*, and the third locking lever 47 becomes in the locked state. Thereby, the load is kept to be applied onto the first runner 41 side.

Figure 7A:
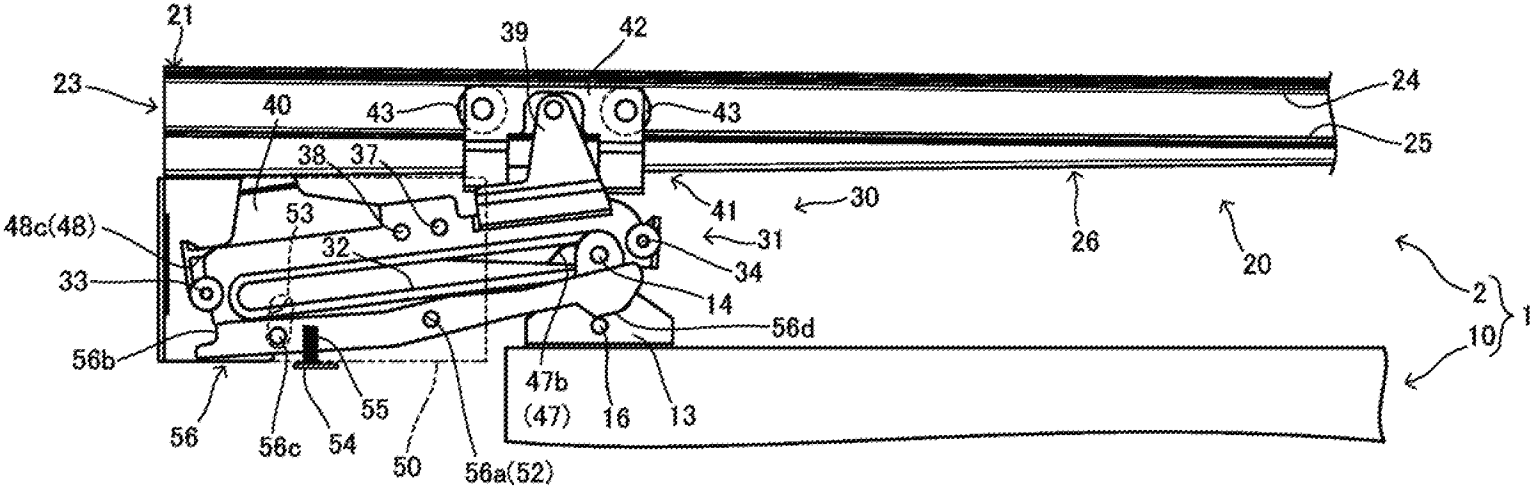
FIG. 7A is a schematic longitudinal sectional view partially broken and corresponding to FIG. 5A.
Figure 7B:
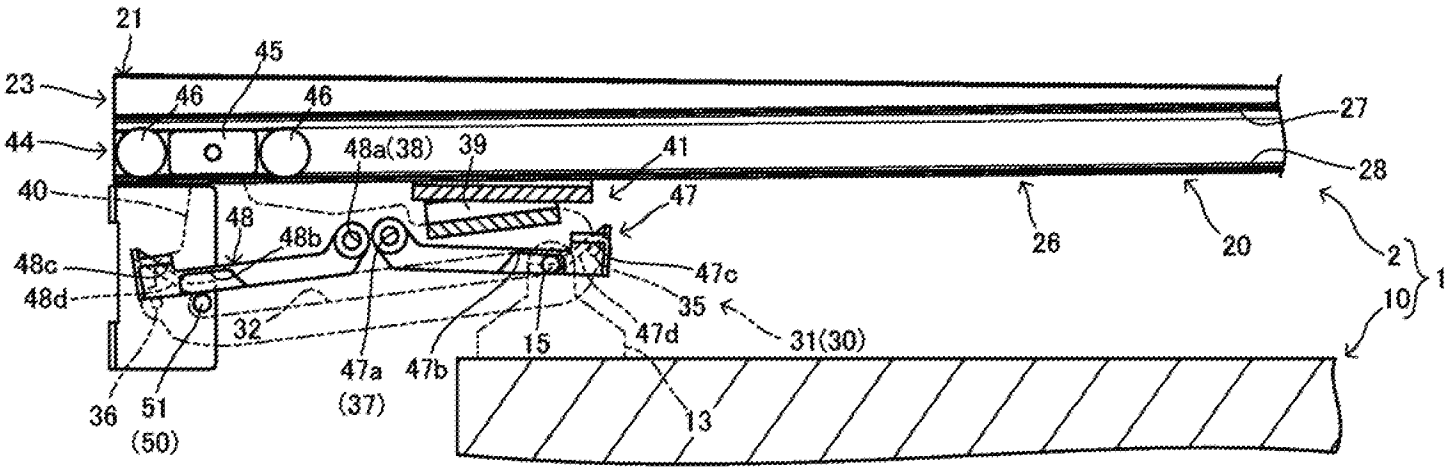
FIG. 7B is a schematic longitudinal sectional view partially broken and corresponding to FIG. 5B.
Figure 8A:
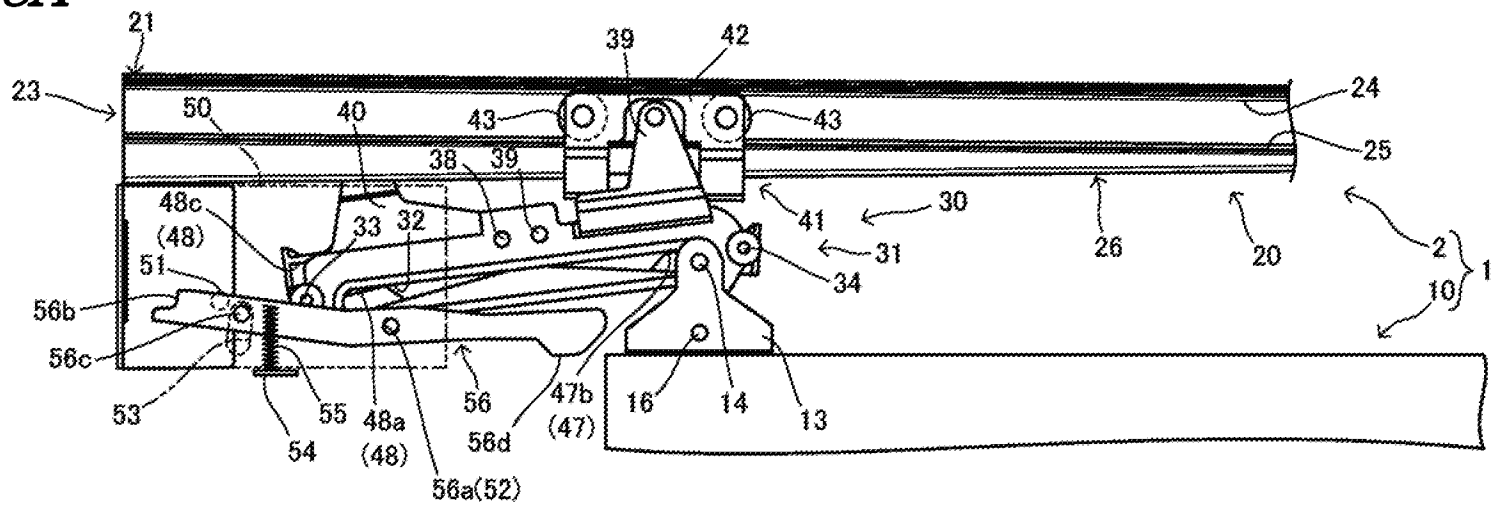
FIG. 8A is a schematic longitudinal sectional view partially broken and corresponding to FIG. 5A.
Figure 8B:
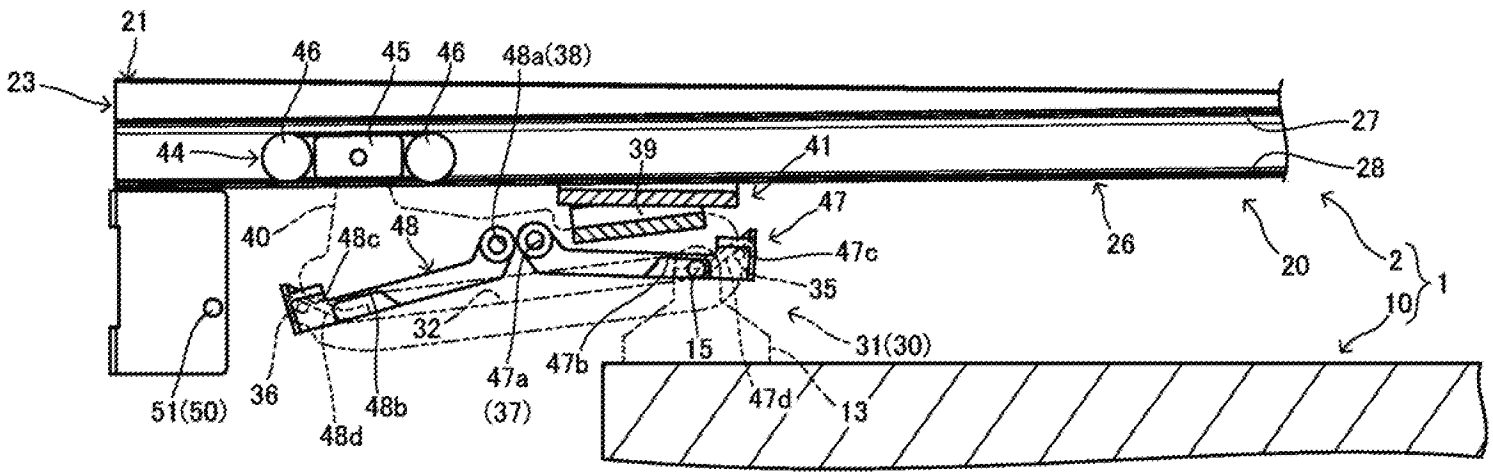
FIG. 8B is a schematic longitudinal sectional view partially broken and corresponding to FIG. 5B.

As illustrated in FIG. 7A, when the door body 10 is further moved slightly toward the opening side, the unlocked portion 56*d* is pushed up by the unlocking portion 16 of the door body 10 by guiding action of the inclined face of the unlocked portion 56*d* of the first locking lever 56 and the first locking lever 56 rotates toward the unlocked side. Namely, the first locking lever 56 rotates around the shaft portion 52 so as to resist energization of the energization member 55 and move the lock portion 56*b* downward and the locking portion 56*b* relative to the first locked portion 33 of the holding member 30 is unlocked. Thereby, as illustrated in FIGS. 8A and 8B, the holding member 30 located on the first end portion 21 side is able to be moved toward the second end portion 22 side. Since the load is applied onto the first runner 41 side, the holding member 30 and the door body 10 are assisted to travel or travel themselves downward the first rail 23 toward the second end portion 22 side, i.e. the opening side. When the door body 10 moves toward the opening side as above, the unlocked portion 48*d* of the fourth locking lever 48 spaces apart from the fourth unlocking potion 51 of the first lock unit 50. Thereby, the abutting piece portion 48*c* of the fourth locking lever 48 is held so as to abut on the fourth lock stopper portion 36 of the switch portion 31; the locking portion 48*b* is located so as to overlap the end portion on the first end portion 21 side of the guide portion 32 seen from the door thickness direction and is in the lockable state.

When the holding member 30 reaches the vicinity of the second end portion 22 following further movement, i.e. self-travelling, of the door body 10 toward the opening side, the second locked portion 34 of the holding member 30 moves so as to be close to or abut along the upward side of the second locking lever 57 (not illustrated in the figures). When the second locked portion 34 of the holding member 30 moves while resisting energization of the energization member 55 and pushing down a region on the locking portion 57*b* side of the second locking lever 57 and the door body 10 is at the fully open position, the second locked portion 34 of the holding member 30 engages with the locking portion 57*b* of the second locking lever 57. Namely, when the second locked portion 34 of the holding member 30 reaches the locking portion 57*b* of the second locking lever 57, the second locking lever 57 is rotated on the lock side by the energization member 55 and becomes in the locked state as illustrated in FIG. 9A. Thereby, movement toward the first end portion 21 side of the holding member 30 that is located on the second end portion 22 side is suppressed.

When the holding member 30 reaches the vicinity of the second end portion 22 in accordance with the movement, i.e. the self-travelling, of the door body 10 toward the opening side as mentioned above, the inclined piece portion of the unlocked portion 47*d* of the third locking lever 47 abuts on the third unlocking portion 51A. By guiding action of the inclined piece portion of the unlocked portion 47*d* as mentioned above, the free end portion of the third locking lever 47 is rotated so as to be pushed by the third unlocking portion 51A. As illustrated in FIG. 9B, when the door body 10 is at the fully open position, the flat piece portion of the unlocked portion 47*d* is held by the third unlocking portion 51A, the locking portion 47*b* is located upward the locked portion 15 of the door body 10, and the third locking lever 47 becomes the unlocked state. Even when the third locking lever 47 is in the unlocked state, because the guide portion 32 is in the upward slope state from the first runner 41 side toward the second runner 44 side at the fully open position of the door body 10, the state in which the load is applied onto the first runner 41 side is maintained.

The door body 10 at the fully open position is in the movable state toward the state in which the load is applied onto the second runner 44 side along the guide portion 32 relative to the switch portion 31 of the holding member 30 in which the movement toward the first end portion 21 side is suppressed.

When the door body 10 at the fully open position is moved on the closing side, substantially similar to the above, the locked portion 15 moves in accordance with the movement of the door body 10, the locked portion 15 engages with the locking portion 48*b*, and the fourth locking lever 48 is in the locked state. Thereby, the state in which the load is applied onto the second runner 44 side is maintained.

When the door body 10 is further moved slightly toward the closing side, substantially similar to the above, by movement of the unlocking portion 16, the locking portion 57*b* of the second locking lever 57 relative to the second locked portion 34 of the holding member 30 is unlocked. Thereby, the holding member 30 that is located on the second end portion 22 side becomes movable toward the first end portion 21 side. Since the state is such that the load is applied onto the second runner 44 side, the holding member 30 and the door body 10 are assisted to travel or travel themselves so as to go downward the second rail 26 toward the first end portion 21 side, i.e. the closing side. When the door body 10 is moved toward the closing side, substantially similar to the above, the third locking lever 47 spaces apart from the third unlocking portion 51A and becomes the lockable state.

When the holding member 30 reaches the vicinity of the first end portion 21 following further movement, i.e. the self-travelling, of the door body 10 toward the closing side, substantially similar to the above, the first locked portion 33 of the holding member 30 engages with the locking portion 56*b* of the first locking lever 56. Namely, the first locking lever 56 becomes in the locked state, and movement of the holding member 30 that is located on the first end portion 21 side toward the second end portion 22 is suppressed.

When the holding member 30 reaches the vicinity of the first end portion 21 following the movement, i.e. the self-travelling, of the door body 10 toward the closing side, substantially similar to the above, the inclined piece portion of the unlocked portion 48*d* of the fourth locking lever 48 abuts on the fourth unlocking portion 51 and the fourth locking lever 48 becomes the unlocked state.

Consequently, the travel assistance device 2 and the sliding door device 1 provided with the travel assistance device 2 of the embodiment assist the travelling on both sides in the rail longitudinal direction of the travelling body (the door body) 10 that travels along the rails 23, 26, simplify the structure, and enhance the durability.

In other words, the first rail 23 and the second rail 26 incline opposite to each other. The runners 41, 44 of the holding member 30 that holds the door body 10 are configured to include a switch mechanism (the switch portion) 31 that is able to be switched between the state in which the runners 41, 44 are assisted to travel downward the first rail 23 and the state in which the runners 41, 44 are assisted to travel downward the second rail 26. Therefore, being traveled along the longitudinal direction of the respective rails 23, 26, the door body 10 is assisted to travel by inclinations of the respective rails 23, 26 and is semi-automatically traveled.

Compared to those with a drive mechanism such as a rack and a gear, or a flat spiral spring, a mechanism in which the rail itself is tilted, or the like, the structure of the rails 23, 26 that are relatively long is simplified, and the durability or an attachment property is enhanced.

In the embodiment, the first runner 41 guided by slidably engaging with the first rail 23 and the second runner 44 guided by slidably engaging with the second rail 26 are provided. The switch portion 31 is configured to be switched between the state in which the load is applied onto the first runner 41 side and the state in which the load is applied onto the second runner 44 side. Therefore, compared with the one, for instance, that is provided with a mechanism that moves a single runner into a state in which the single runner is guided by the first rail 23 and a state in which the single runner is guided by the second rail 26, the structure is further simplified, and the durability is further enhanced.

In the embodiment, the holding member 30 is configured to be provided with the first runner 41 and the second runner 44 that are arranged apart from each other in the rail longitudinal direction and is configured to be provided with the switch portion 31 that slidably holds the door body 10 in the rail longitudinal direction. When the door body 10 is moved in the rail longitudinal direction relative to the switch portion 31, the switch portion 31 is configured to be switched between the state in which the load is applied onto the first runner 41 side and the state in which the load is applied onto the second runner 44 side. Therefore, by moving the door body 10 relative to the switch portion 31, switching as mentioned above is performed and operability is enhanced as compared with the one, for instance, that requires operating a handle or the like for switching.

In the embodiment, the first runner 41 and the second runner 44 are arranged in such a manner that a side onto which the load is applied becomes the head position when the first runner 41 and the second runner 44 are assisted to travel along the respective rails 23, 26. Therefore, when the switching is performed by moving the door body 10 relative to the switch portion 31, by moving the door body 10 to an intentional side, switching as mentioned above is able to be performed. Thereby, for instance, when switching is performed by moving the door body 10 relative to the switch portion 31, the door body 10 is able to be effectively assisted to travel as compared with the one that requires moving the door body 10 on a different side from the intentional side.

In the embodiment, the travel assistance device 2 is provided with the first locking mechanism (the first locking lever) 56 that suppresses the movement of the switch portion 31 in the unlockable manner when the door body 10 is moved into the state in which the load is applied onto the first runner 41 side. Therefore, in switching the load from the second runner 44 side into the first runner 41 side, the door body 10 is able to be moved relative to the switch portion 31 in which the movement is suppressed by the first locking lever 56. In the embodiment, the travel assistance device 2 is provided with the second locking mechanism (the second locking lever) 57 that suppresses the movement of the switch portion 31 in the unlockable manner when the door body 10 is moved into the state in which the load is applied onto the second runner 44 side. Therefore, in switching the load from the first runner 41 side into the second runner 44 side, the door body 10 is able to be moved relative to the switch portion 31 in which the movement is suppressed by the second locking lever 57. Since the travel assistance device 2 is configured to be provided with the first locking lever 56 and the second locking lever 57, when the switching as mentioned above is performed, usability is enhanced as compared with the one in which the movement of the switch portion 31 is required to be suppressed by firmly grasping the switch portion 31, or the like.

In the embodiment, the travel assistance device 2 is provided with the third locking mechanism (the third locking lever) 47 that maintains the state in which the load is applied onto the first runner 41 side in the unlockable manner. Therefore, the door body 10 is suppressed so as not to move from the state in which the load is applied onto the first runner 41 side into the state in which the load is applied onto the second runner 44 side, and the door body 10 is assisted to smoothly travel along the inclination of the first rail 23. In the embodiment, the travel assistance device 2 is provided with the fourth locking mechanism (the fourth locking lever) 48 that maintains the state in which the load is applied onto the second runner 44 side in the unlockable manner. Therefore, the door body 10 is suppressed so as not to move from the state in which the load is applied onto the second runner 44 side into the state in which the load is applied onto the first runner 41 side, and the door body 10 is assisted to smoothly travel along the inclination of the second rail 26. Since the travel assistance device 2 is configured to be provided with the third locking lever 47 and the fourth locking lever 48, usability is enhanced as compared with the one in which the movement of the door body 10 relative to the switch portion 31 is required to be suppressed by a separate member or fingers, or the like.

In the embodiment, when the door body 10 is moved relative to the switch portion 31 into the state in which the load is applied onto the first runner 41 side in such a state in which the movement of the switch portion 31 is suppressed by the first locking lever 56, the third locking lever 47 is configured to become in the locked state and the first locking lever 56 is configured to be unlocked. Therefore, by moving the door body 10, the third locking lever 47 is locked, the first locking lever 56 is unlocked, and the load is switched to be applied onto the first runner 41 side. Thereby, usability is enhanced as compared with the one in which manual operation or the like is required for locking the third locking lever 47 and unlocking the first locking lever 56.

In the embodiment, when the door body 10 is further moved slightly after the third locking lever 47 is set in the locked state, the first locking lever 56 is configured to be unlocked. Therefore, since the switching into the state in which the load is applied onto the first runner 41 side is surely performed as compared with the one in which, for instance, the third locking lever 47 is locked and the first locking lever 56 is unlocked at the same time, malfunction or the like is suppressed.

When the first locking mechanism 56 is unlocked and the door body 10 is further moved in such a manner that the switch portion 31 is at the position where the movement of the switch portion 31 is suppressed by the second locking mechanism 57, the third locking lever 47 is configured to be unlocked. Therefore, the third locking lever 47 is unlocked by moving the door body 10, and usability is enhanced as compared with the one in which manual operation or the like is required for unlocking the third locking lever 47.

In the embodiment, when the door body 10 is moved relative to the switch portion 31 into the state in which the load is applied onto the second runner 44 side in such a state in which the movement of the switch portion 31 is suppressed by the second locking lever 57, the fourth locking lever 48 is configured to be in the locked state and the second locking lever 57 is configured to be unlocked. Therefore, usability is enhanced similar to the above.

In the embodiment, when the door body 10 is further moved slightly after the fourth locking lever 48 is set in the locked state, the second locking lever 57 is configured to be unlocked. Therefore, since the switching into the state in which the load is applied onto the second runner 44 side is surely performed similar to the above, malfunction or the like is suppressed. When the second locking lever 57 is unlocked and the door body 10 is further moved in such a manner that the switch portion 31 is at the position where the movement of the switch portion 31 is suppressed by the first locking lever 56, the fourth locking lever 48 is configured to be unlocked. Therefore, usability is enhanced similar to the above.

In the embodiment, the pair of first rails 23, 23 is provided so as to be located on both sides in the width direction of the second rail 26. The pair of first runners 41, 41 is configured to be provided for the holding member 30 so as to be respectively guided by the pair of the first rails 23, 23. Therefore, the holding member 30 (the door body 10) is stably guided as compared with the one in which, for instance, a single first rail 23 and a single second rail 26 are provided in parallel in the width direction or the vertical direction. Such a swing of the lower end side into the rail width direction is suppressed in such a case in which the travelling body is vertically long the same as the door body 10.

In the embodiment, the travel assistance device 2 is configured to be provided with the plurality of holding members 30, 30 that respectively hold the door body 10 at the plurality of regions apart from each other in the rail longitudinal direction. The travel assistance device 2 is configured to be provided in tandem with the plurality of first rails 23, 23 and second rails 26, 26 that respectively guide the runners 41, 44, 41, 44 of the plurality of holding members 30, 30. Therefore, even when the travelling body is relatively great in size in the rail longitudinal direction the same as the door body 10, the travelling is able to be stably assisted.

Figure 10A:
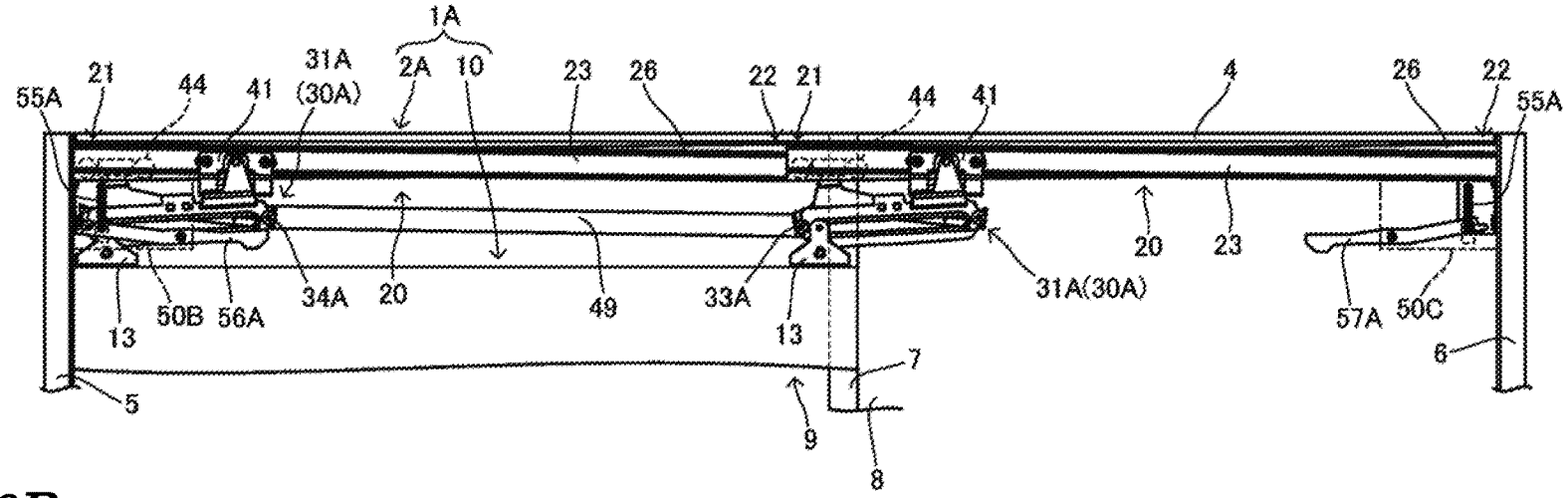
FIGS. 10A and 10B schematically illustrate an example of the travel assistance device and the sliding door device of another embodiment of the present invention and are schematic front views partially broken and omitted.
Figure 10B:
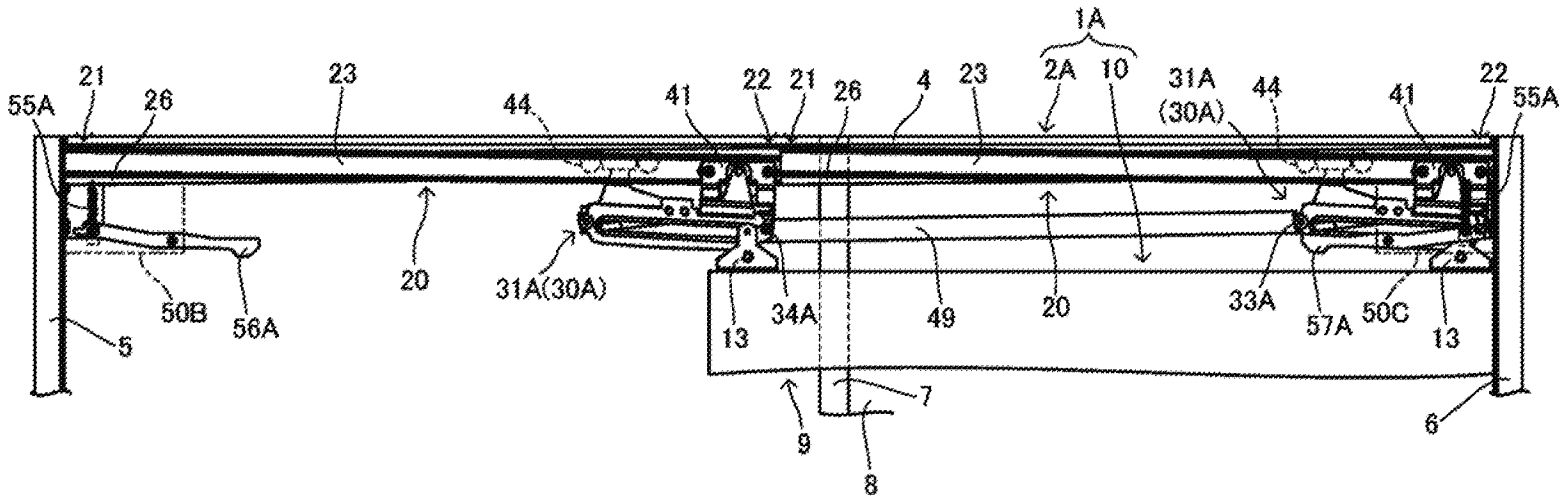

Another embodiment of the present invention is explained below with reference to the drawings FIG. 10 schematically illustrates an example of the travel assistance device and the sliding door device of the second embodiment.

Figure 11A:
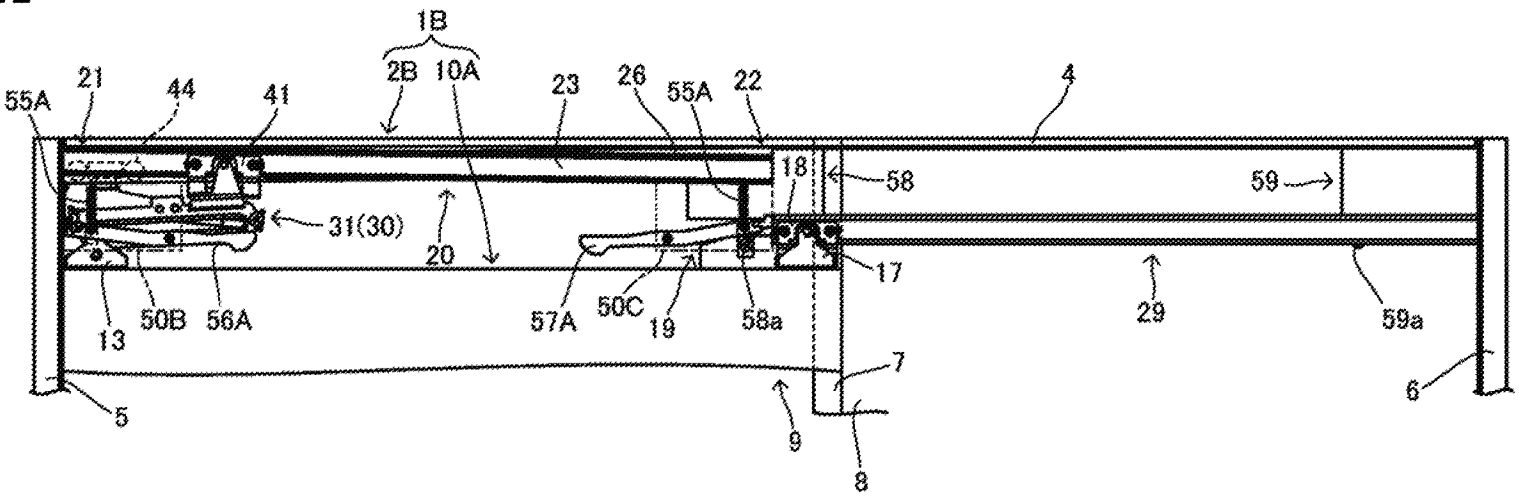
FIGS. 11A and 11B schematically illustrate an example of the travel assistance device and the sliding door device of another embodiment of the present invention and are schematic front views partially broken and omitted.
Figure 11B:
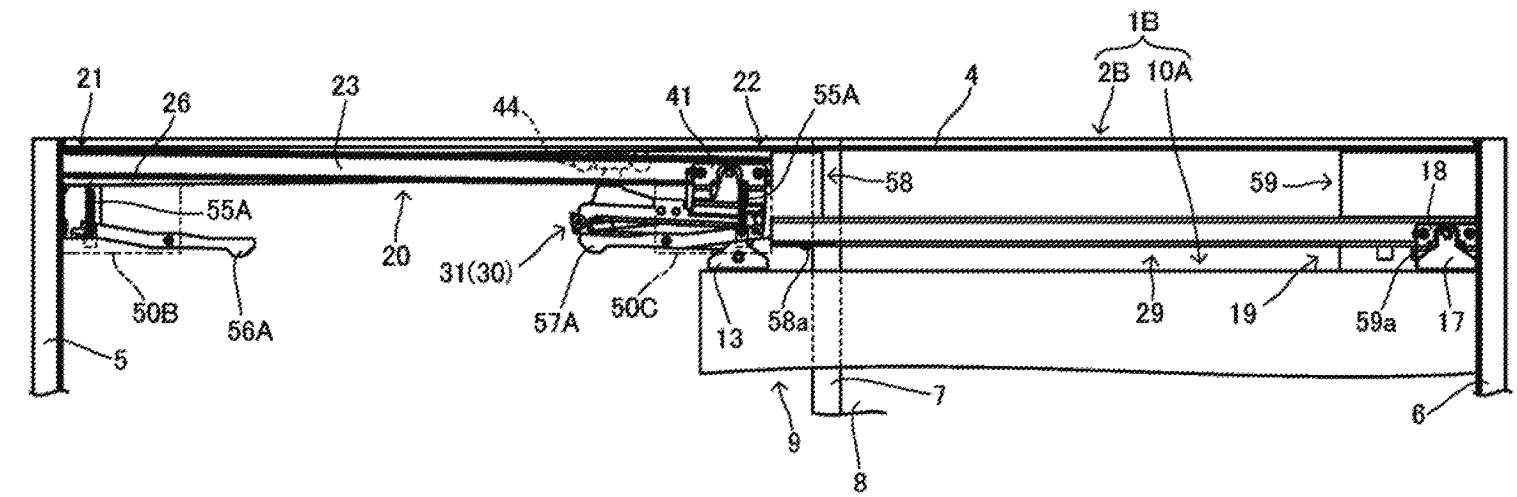

Difference with the first embodiment is mainly explained, common structures are allotted with the same reference numerals, and the explanation for the common structures is omitted or simplified. FIGS. 10 and 11 illustrate an example in which the respective rails are shorter in length as compared with an example illustrated in FIG. 1.

As illustrated in FIG. 10, a travel assistance device 2A and a sliding door device 1A provided with the travel assistance device 2A of the embodiment differ from the first embodiment in that a connection portion 49 that mutually connects a pair of holding members 30A, 30A that are respectively connected to the upper end side of the door tip side end portion and the door end portion of the door body 10. In spite of such an aspect in which a couple of first locking levers 56, 56 and a couple of second locking levers 57, 57 that suppress movement of the respective holding members 30A, 30A on both sides in the rail longitudinal direction, a single first locking lever 56A and a single second locking lever 57A are configured to be provided.

The connection member 49 is long substantially along the door width direction and end portions of the connection member 49 in the longitudinal direction are respectively connected to switch portions 31A, 31A of the holding members 30A, 30A. In the embodiment, end portions on close sides of the respective switch portions 31A, 31A are configured to be provided by the connection member 49. In the embodiment, the respective end portions of the connection member 49 in the longitudinal direction are configured to be rotatably connected to the end portions on the close sides of the respective switch portions 31A, 31A around shafts 34A, 33A along the door thickness direction so as to permit displacement of the switch portions 31A, 31A displaced as above.

The figures illustrate an example in which the switch portion 31A of the holding member 30A on the door tip side is provided with the connection shaft 34A that rotatably connects the end portion on the door tip side of the connection member 49 in place of the second locked portion 34 as mentioned above. The figures also illustrate an example in which the switch portion 31A of the holding member 30A on the door end side is provided with the connection shaft 33A that rotatably connects the end portion on the door end side of the connection member 49 in place of the first locked portion 33 as mentioned above.

In the embodiment, the single first locking lever 56A that suppresses movement of the respective switch portions 31A, 31A in moving the door body 10 into the state in which the load is applied onto the first runners 41, 41 sides is configured to be provided on the first end portion 21 side of the rail unit 20 on the opening 9 side. The single second locking lever 57A that suppresses movement of the respective switch portions 31A, 31A in moving the door body 10 into the state in which the load is applied onto the second runners 44, 44 sides is provided on the second end portion 22 side of the rail unit 20 on the wing wall 8 side. Namely, the second locking lever and the first locking lever are not to be provided on the second end portion 22 side of the rail unit 20 on the opening 9 side and the first end portion 21 side of the rail unit 20 on the wing wall 8 side.

Namely, the movement of the respective switch portions 31A, 31A in moving the door body 10 into the state in which the load is applied onto the first runner 41, 41 sides is able to be suppressed by the single first locking lever 56A. The movement of the respective switch portions 31A, 31A in moving the door body 10 into the state in which the load is applied onto the second runners 42, 42 sides is able to be suppressed by the single second locking lever 57A.

In the embodiment, energization members 55A, 55A that energize the first locking lever 56A and the second locking lever 57A toward the lock side are extension coil springs that energize the regions on the locking portions 56*b*, 57*b* sides so as to pull upward (refer to FIGS. 5A, 9A, or the like). A first lock unit 50B and a second lock unit 50C are provided with holding portions that respectively hold upper end portions of the energization members 55A, 55A, not specifically illustrated in the figures. An example is shown such that the regulated portions 56*c*, 57*c* of the first locking lever 56A and the second locking lever 57A (refer to FIGS. 5A, 9A, or the like) are respectively connected with lower end portions of the energization members 55A, 55A, not specifically illustrated in the figures.

The third unlocking portion 51A (refer to FIG. 9B) similar to the above that unlocks the third locking lever 47 of the switch portion 31A of the holding member 30A on the door tip side is provided on a proper place on the second end portion 22 side of the rail unit 20 on the opening 9 side, not illustrated in the figures. The fourth unlocking portion 51 (refer to FIG. 5B) similar to the above that unlocks the fourth locking lever 48 of the switch portion 31A of the holding member 30A on the door end side is provided on a proper place on the first end portion 21 side of the rail unit 20 on the wing wall 8 side.

Also in the embodiment, the door body 10 is opened or closed substantially similar to the first embodiment.

Also in the travel assistance device 2A and the sliding door device 1A provided with the travel assistance device 2A of the embodiment, an effect is exerted substantially similar to the first embodiment.

In the embodiment, the connection member 49 that mutually connects the pair of holding members 30A, 30A on both sides of the door body 10 in the door width direction is provided. Therefore, the movement of the respective switch portions 31A, 31A in moving the door body 10 so as to respectively move the centers of gravity of the holding members 30A, 30A is suppressed by the single first locking lever 56A and the single second locking lever 57A, and the structure is further simplified.

In the embodiment, the end portions on the close sides of the switch portions 31A, 31A are configured to be connected to each other by the connection member 49. Therefore, the structure is further simplified as compared with the one, for instance, in which end portions on remote sides of the switch portions 31A, 31A are connected to each other by the connection member 49. The end portions on the remote sides of the respective switch portions 31A, 31A can be configured to be connected to each other by the connection member 49. In such a case, the single second locking lever 57A can be configured to be provided on the second end portion 22 side of the rail unit 20 on the opening 9 side, and the single first locking lever 56A can be configured to be provided on the first end portion 21 side of the rail unit 20 on the wing wall 8 side.

The energization members 55A, 55A that energize the first locking lever 56A and the second locking lever 57A toward the lock side are not limited to the extension coil spring or the compression coil spring that is explained in the first embodiment as mentioned above, and can be modified in various shapes.

Another embodiment of the present invention is explained below with reference to the drawings.

FIGS. 11 and 12 illustrate an example of the travel assistance device and the sliding door device of a third embodiment.

Difference with the first embodiment is mainly explained, common structures are allotted with the same reference numerals, and the explanation for the common structures is omitted or simplified.

As illustrated in FIG. 11, a travel assistance device 2B and a sliding door device 1B provided with the travel assistance device 2B of the third embodiment differ from those in the first embodiment in that a second region holding member 18 that holds a second region of a door body 10A is provided in addition to the holding member 30 that holds a first region of the door body 10A. The first rail 23 and the second rail 26 that guide the runners 41, 44 of the holding member 30 and a third rail 29 that guides the second region holding member (runner) 18 and arranged so as to extend in the horizontal direction are configured to be provided in tandem.

In the embodiment, the holding member 30 similar to the first embodiment is connected to a door tip side end portion, i.e. the first region, of the door body 10A along the rail longitudinal direction, and the second region holding member 18 is connected to a door end portion, i.e. the second region, of the door body 10A along the rail longitudinal direction. Namely, having the first rail 23 and the second rail 26 similar to the above, the rail unit 20 is provided on the opening 9 side, and is provided with the third rail 29 in tandem on the wing wall 8 side.

Specifically in the embodiment, the second region holding member 18 constitutes a third runner 18 that slidably engages with and is guided by the third rail 29. An upper end portion of a door end portion of the door body 10A is provided with a connection portion 17 that is connected to and held by the third runner 18. The connection portion 17 is provided so as to protrude upward from an upper end face of the door end portion of the door body 10A. In the embodiment, the connection portion 17 is configured to be rotatably connected to the third runner 18 around the shaft along the door thickness direction so as to permit a vertical motion on the door tip side of the door body 10A. The third runner 18 is provided with the rolling element similar to the above that is rotatable around the shaft along the door thickness direction.

The third rail 29 is configured to be provided with a guide groove that receives a rolling element of the third runner 18. A guide face in the guide groove of the third rail 29, i.e. a travelling face of the rolling element, is in a horizontal face shape facing upward. Although the figures illustrate an example in which the guide groove of the third rail 29 is provided so as to open outward in the door thickness direction, the guide groove of the third rail 29 can be provided so as to open downward. In such a case, the third runner 18 can be appropriately modified. Although the figures illustrate an example in which the third rail 29 is located downward further than the rail unit 20 on the opening 9 side, the embodiment is not limited to such an aspect, and the third rail 29 can be configured to be provided at the substantially similar height with the rail unit 20 on the opening 9 side. In such a case, the connection portion 17 or the like can be appropriately modified.

In the embodiment, cushioning mechanisms 58, 59 that decelerate the door body 10A moving toward at least one side of the closed position and the fully open position and that relieve a rebound or an impact are configured to be provided. In the embodiment, the closed side cushioning mechanism 58 that decelerates the door body 10A moving toward the closed position and the fully open side cushioning mechanism 59 that decelerates the door body 10A moving toward the fully open position are provided. The closed side cushioning mechanism 58 is configured to be provided on an end portion on a mullion 7 side, i.e. a first end portion side of the third rail 29 in the rail longitudinal direction, and the fully open side cushioning mechanism 59 is configured to be provided on an end portion on a door end side longitudinal frame 6 side, i.e. a second end portion side of the third rail 29 in the rail longitudinal direction.

As illustrated in FIG. 12, the cushioning mechanisms 58, 59 are configured similar to each other and provided in the linearly symmetric shape seen from the door thickness direction. The cushioning mechanisms 58, 59 are provided with operation arms 58*a*, 59*a* that are operated by action portions 19*a*, 19*c* of an action member 19 that is provided for the door body 10A and is to be mentioned below.

The operation arms 58*a*, 59*a* are configured to be displaced relative to the door body 10A by the action portions 19*a*, 19*c* of the action member 19 and to decelerate the door body 10A. In main bodies of the cushioning mechanisms 58, 59, an appropriate dumper (an appropriate shock absorber) that becomes operation resistance of the displaced operation arms 58*a*, 59*a* is provided, and the door body 10A is decelerated by the operation resistance of the dumper such as viscose resistance of working fluid or the like. The figures illustrate an example in which tip end portions of the operation arms 58*a*, 59*a* are provided with a tip end roller that is rotatable around the shaft along the door thickness direction.

The cushioning mechanisms 58, 59 can be provided with a stopper portion that regulates further rotation of the operation arms 58*a*, 59*a* toward the closed side or the open side when the door body 10A is at the closed position or the fully open position. The cushioning mechanisms 58, 59 can be provided with an energization member such as a spring that energizes the operation arms 58*a*, 59*a* toward a normal state side.

The action member 19 is provided on the upper end portion of the door end portion of the door body 10A. The action member 19 is provided in parallel to the connection portion 17 in the door thickness direction so as to protrude upward from the upper end face of the door end portion of the door body 10A. The action member 19 is provided with the closed side action portion 19*a* that operates the operation arm 58*a* of the closed side cushioning mechanism 58 and the fully open side action portion 19*c* that operates the operation arm 59*a* of the fully open side cushioning mechanism 59. In the embodiment, the action member 19 is configured to be provided with a closed side engagement recessed portion 19*b* that receives the tip end portion of the operation arm 58*a* of the closed side cushioning mechanism 58 and a fully open side engagement recessed portion 19*d* that receives the tip end portion of the operation arm 59*a* of the fully open side cushioning mechanism 59. The action member 19 is configured to be provided with a central protrusion portion 19*e* on a central region along the door width direction so as to divide the closed side engagement recessed portion 19*b* and the fully open side engagement recessed portion 19*d*, and is configured to be provided with the closed side protrusion portion 19*a* and the fully open side protrusion portion 19*c* that constitute the action portions on both end side regions along the door width direction.

The closed side protrusion portion 19*a* and the fully open side protrusion portion 19*c* are inclined faces that are inclined in such a manner that respective upper faces of the closed side protrusion portion 19*a* and the fully open side protrusion portion 19*c* rise toward the central protrusion portion 19*e* in order to displace the operation arms 58*a*, 59*a* of the respective cushioning mechanisms 58, 59.

Also in the embodiment, a door tip side end portion side of the door body 10A is opened or closed by being guided by the rail unit 20 substantially similar to the first embodiment. A door end portion side of the door body 10A is opened or closed by being guided by the third rail 29. To be mentioned below, the door body 10A is decelerated respectively in a vicinity region of the closed position and a vicinity region of the fully open position.

Figure 12A:
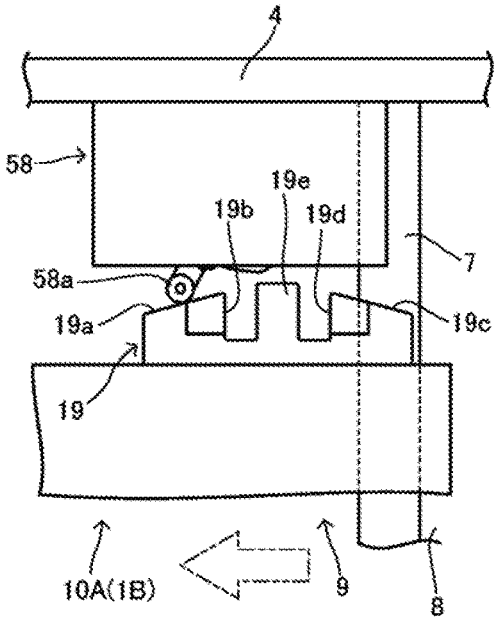
FIGS. 12A to 12D schematically illustrate an example of a cushioning mechanism provided for the sliding door device and are schematic front views partially broken and omitted.
Figure 12B:
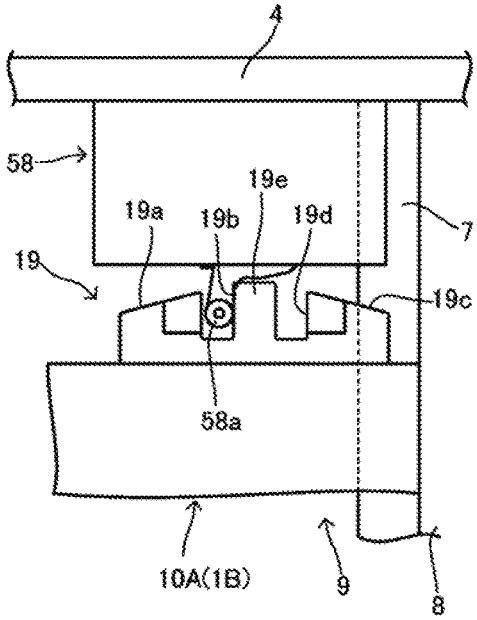

Namely, as illustrated in FIG. 12A, when the door body 10A is moved from the opening side toward the closed position, the operation arm 58*a* of the closed side cushioning mechanism 58 is displaced so as to be rotated by action of the closed side protrusion portion 19*a* and the door body 10A is decelerated. As illustrated in FIG. 12B, the tip end portion of the operation arm 58*a* is inserted into the closed side engagement recessed portion 19*b* and the door body 10A becomes at the closed position.

Figure 12C:
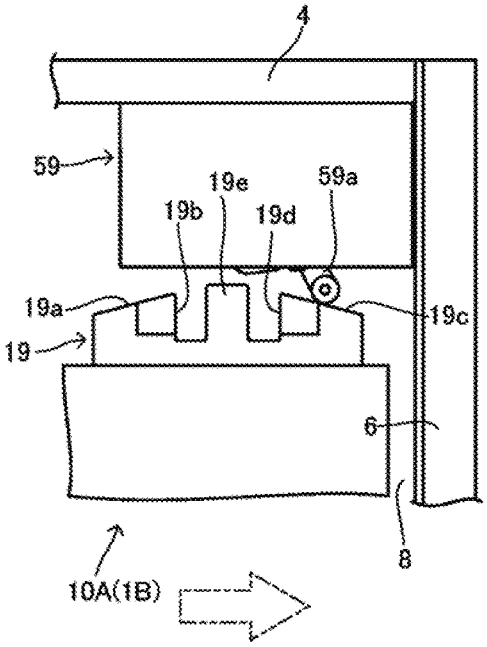
Figure 12D:
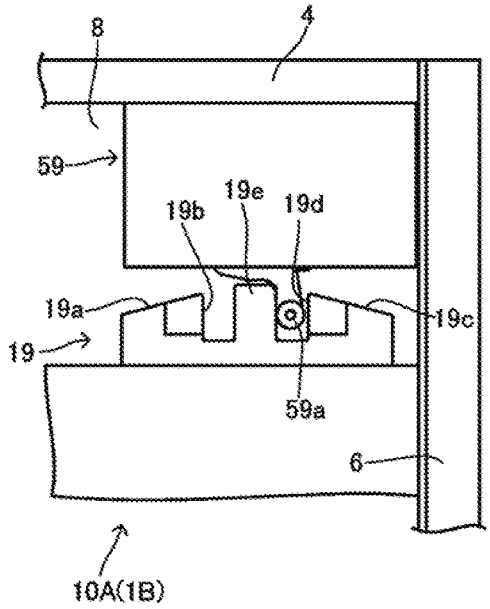

As illustrated in FIG. 12C, when the door body 10A is moved from the closed side toward the fully open position, the operation arm 59*a* of the fully open side cushioning mechanism 59 is displaced so as to be rotated by action of the fully open side protrusion portion 19*c* and the door body 10A is decelerated. As illustrated in FIG. 12D, the tip end portion of the operation arm 59*a* is inserted into the fully open side engagement recessed portion 19*d* and the door body 10A becomes at the fully open position.

Also in the travel assistance device 2B and the sliding door device 1B provided with the travel assistance device 2B of the embodiment, an effect is exerted substantially similar to the first embodiment.

In the embodiment, in addition to the holding member 30 that holds the first region of the door body 10A, the second region holding member 18 that holds the second region of the door body 10A is provided. The first rail 23 and the second rail 26 that guide the runners 41, 44 of the holding member 30, and the third rail 29 that guides the second region holding member (the third runner) 18 and is arranged so as to extend in the horizontal direction are provided in tandem. Therefore, the door body 10A is able to be assisted to travel on both sides in the rail longitudinal direction and the structure is further simplified. Since the respective rails 23, 26 are configured to be inclined on the rail unit 20 side of the opening 9 side, the door body 10A and the switch portion 31 that holds the door body 10A are displaced, and the cushioning mechanism (a soft closing mechanism) is considered difficult to be provided. In the embodiment, as mentioned above, the cushioning mechanisms 58, 59 and the action member 19 that operates the cushioning mechanisms 58, 59 are able to be provided on the third rail 29 side extending horizontally, the second region side of the door body 10A that is guided by the third rail 29, or the like.

In the embodiment, the cushioning mechanisms 58, 59 that decelerate the door body 10A moving toward at least one side of the closed position and the fully open position are configured to be provided. Therefore, an impact of the door body 10A that moves at least one side of the closed position and the fully open position is able to be relieved.

In the embodiment, the closed side cushioning mechanism 58 that decelerates the door body 10A moving toward the closed position and the fully open side cushioning mechanism 59 that decelerates the door body 10A moving toward the fully open position are provided. Therefore, the impact of the door body 10A moving toward either side of the closed position and the fully open position are also able to be relieved.

The closed side cushioning mechanism 58, the fully open side cushioning mechanism 59, and the action member 19 that operates the operation arms 58*a*, 59*a* of the cushioning mechanisms 58, 59 are not limited to the above embodiment and are able to be modified in various shapes. The embodiment can be such that the closed side cushioning mechanism 58, the fully open side cushioning mechanism 59, and the action member 19 are not provided.

Different structures explained in the respective embodiments as mentioned above can be applied by appropriate combining or rearranging.

The first embodiment and the second embodiment show the example in which both end portions in the door width direction of the door body 10 are connected to the pair of holding members 30(30A), 30(30A) and two rail units 20, 20 are provided in tandem in the door width direction, but the embodiment is not limited to such an aspect. For instance, the aspect can be such that the upper end portion of the door body 10 is connected to three or more holding members 30(30A) and three or more rail units 20 are provided in tandem in the door width direction. Further, in place of such an aspect that the holding member 30(30A) that holds the plurality of regions of the door body 10 and the plurality of rail units 20 are provided in tandem in the door width direction, an aspect can be such that the holding member 30(30A) that holds a single region such as a central portion of the door body 10 in the door width direction, and a single rail unit 20 is provided.

The respective embodiments show the example in which the rail unit 20 is fixed to the upper frame 4, but the rail unit 20 can be fixed to a ceiling face or the like or can be fixed to a ceiling in an embedded state.

The respective embodiments show the example in which the pair of first rails 23, 23 is provided on both sides in the width direction of the single second rail 26 and the pair of first runners 41, 41 guided by the pair of first rails 23, 23 are provided on the holding member 30(30A), but the embodiment is not limited to such an aspect. Contrary to the above, the structure can be such that a pair of second rails 26 is provided on both sides in the width direction of the single first rail 23 and the pair of second runners 44 guided by the pair of the second rails 26 is provided on the holding member 30(30A). The structure can also be such that the single first rail 23 and the single second rail 26 are provided and the respective runners 41, 44 respectively guided by the single first rail 23 and the single second rail 26 are provided on the holding member 30(30A). The respective embodiments show the example in which the first rail 23 and the second rail 26 are configured to be provided in parallel in the width direction, but the first rail 23 and the second rail 26 can be configured to be provided in parallel in the vertical direction.

The respective embodiments show the example in which the respective locking mechanisms 56(56A), 57(57A), 47, 48 are locked or unlocked in accordance with movement of the door body 10 (10A), but the embodiment is not limited to such an aspect. Part or all of the locking mechanisms 56(56A), 57(57A), 47, 48 can be configured to be locked or unlocked by an appropriate operation portion or the like. Further, the structure can be such that at least one of the locking mechanisms 56(56A), 57(57A), 47, 48 is not provided, movement of the switch portion 31(31A) is suppressed by an appropriate locking member, human power, or the like, and the state in which the load is applied onto the respective runner 41, 44 sides is maintained by the appropriate locking member, human power, or the like.

The respective embodiments show the example in which the first runner 41 and the second runner 44 are provided apart from each other in the rail longitudinal direction of the holding member 30 (30A), but the embodiment is not limited to such an aspect. For instance, the first runner 41 and the second runner 44 can be configured to be provided apart from each other in the rail width direction of the holding member 30 (30A). In such a case, the switch portion 31(31A) can be configured to slidably hold the door body 10(10A) in the rail width direction, and the center of gravity can be configured to be moved as mentioned above by moving the door body 10(10A) relative to the switch portion 31(31A) in the rail width direction.

When the first runner 41 travels downward along the first rail 23 and the second runner 44 travels downward along the second rail 26, the door body 10(10A) is not limited to self-travelling and can be such that human power is required.

The respective embodiments show the example in which the first runner 41 guided by the first rail 23 and the second runner 44 guided by the second rail 26 are provided, but the single runner guided by both of the first rail 23 and the second rail 26 can be provided. In such a case, an appropriate mechanism that moves the runner into the state in which the runner is guided by the first rail 23 and into the state in which the runner is guided by the second rail 26 can be provided.

The travelling body that is assisted to travel by the travel assistance devices 2, 2A, 2B of the respective embodiments is not limited to the door body 10(10A), and can be a drawer, a tray or a vessel on which various articles are able to be placed, or a hook that hangs various articles. Specifically in the embodiment, the travel assistance devices 2, 2A, 2B can be the conveyance assistance devices 2, 2A, 2B that assist conveyance of various articles. The travelling body that is assisted to travel by the travel assistance devices 2, 2A, 2B of the above respective embodiments is able to be modified in various shapes.

The above respective embodiments show the example in which the switch portion 31(31A) of the holding member 30(30A) suspends and holds the travelling body 10(10A), but the embodiment is not limited to such an aspect. For instance, the switch portion 31(31A) of the holding member 30(30A) can be the one that holds the travelling body 10(10A) in a cantilevered state in the rail width direction, or that holds the travelling body 10(10A) so as to lift upward. For instance, the aspect can be such that the plurality of regions that are apart from each other in the rail width direction of the travelling body 10(10A) are assisted to travel by the travel assistance devices 2, 2A, 2B that are provided at the plurality of regions apart from each other in the rail width direction. The aspect can be such that the plurality of regions that are apart from each other in the vertical direction of the travelling body 10(10A) are assisted to travel by the travel assistance devices 2, 2A, 2B that are provided at the plurality regions apart from each other in the vertical direction. A travel assistance aspect of the travelling body by the travel assistance devices 2, 2A, 2B of the respective embodiments is able to be variously modified.

REFERENCE SIGNS LIST

1, 1A, 1B sliding door device
2, 2A, 2B travel assistance device
10,10A door body (travelling body)
18 third runner (second region holding member)
21 first end portion
22 second end portion
23 first rail
26 second rail
29 third rail
30, 30A holding member
31, 31A switch portion (switch mechanism)
41 first runner (runner)
44 second runner (runner)
47 third locking lever (third locking mechanism)
48 fourth locking lever (fourth locking mechanism)
56, 56A first locking lever (first locking mechanism)
57, 57A second locking lever (second locking mechanism)

The invention claimed is:

1. A travel assistance device, comprising:

a first rail inclined downward from a first end portion side to a second end portion side in a longitudinal direction;

a second rail provided substantially parallel to the first rail and inclined, in an opposite direction to the first rail, downward from the second end portion to the first end portion in the longitudinal direction;

a holding member having a runner portion slidably guided by the rails and holding a travelling body; and a switch mechanism configured to be switched between a state in which the runner portion is guided by the first rail and is assisted to travel downward on the first rail by a load applied to the runner portion and a state in which the runner portion is guided by the second rail and is assisted to travel downward on the second rail by the load applied to the runner portion.

2. The travel assistance device as set forth in claim 1, wherein the runner portion comprises a first runner slidably engaged with and guided by the first rail and a second runner slidably engaged with and guided by the second rail, and wherein the switch mechanism is configured to be switched between a state in which the load is applied onto a side of the first runner and a state in which the load is applied onto a side of the second runner.

3. The travel assistance device as set forth in claim 2, wherein the holding member, in such a state that the first runner and the second runner are arranged apart from each other in a rail longitudinal direction, slidably holds the travelling body in the rail longitudinal direction, has a switch portion constituting the switch mechanism, and is configured in such a manner that the switch mechanism is switched between the state in which the load is applied onto the side of the first runner and the state in which the load is applied onto the side of the second runner when the travelling body is moved relative to the switch portion in the rail longitudinal direction.

4. The travel assistance device as set forth in claim 3, wherein the first runner is provided so as to be located on the second end portion side in the longitudinal direction further than the second runner in the rail longitudinal direction.

5. The travel assistance device as set forth in claim 4, comprising:

a first locking mechanism suppressing a movement of the switch portion in an unlockable manner when the travelling body is configured to be moved into the state in which the load is applied onto the side of the first runner;

a second locking mechanism suppressing the movement of the switch portion in the unlockable manner when the travelling body is configured to be moved into the state in which the load is applied onto the side of the second runner;

a third locking mechanism maintaining the state in which the load is applied onto the side of the first runner in the unlockable manner; and a fourth locking mechanism maintaining the state in which the load is applied onto the side of the second runner in the unlockable manner.

6. The travel assistance device as set forth in claim 5, wherein in a state of suppressing the movement of the switch portion by the first locking mechanism, the third locking mechanism is in a locked state and the first mechanism is unlocked when the travelling body is moved relative to the switch portion into the state in which the load is applied onto the side of the first runner, and the third locking mechanism is unlocked when the travelling body further moves in such a manner that the switch portion is at a position where the movement of the switch portion is suppressed by the second locking mechanism, and wherein in a state of suppressing the movement of the switch portion by the second locking mechanism, the fourth locking mechanism is in the locked state and the second mechanism is unlocked when the travelling body is moved relative to the switch portion into the state in which the load is applied onto the side of the second runner, and the fourth locking mechanism is unlocked when the travelling body further moves in such a manner that the switch portion is at a position where the movement of the switch portion is suppressed by the first locking mechanism.

7. The travel assistance device as set forth in claim 6, wherein the first rail is provided so as to be positioned on one side of the second rail in the width direction, the first rail is further provided so as to be positioned on the other side of the second rail in the width direction, and wherein the first runner is provided so as to be guided by the first rail on one side of the second rail in the width direction, and the first runner is further provided so as to be guided by the first rail on the other side of the second rail in the width direction.

8. The travel assistance device as set forth in claim 5, wherein the first rail is provided so as to be positioned on one side of the second rail in the width direction, the first rail is further provided so as to be positioned on the other side of the second rail in the width direction, and wherein the first runner is provided so as to be guided by the first rail on one side of the second rail in the width direction, and the first runner is further provided so as to be guided by the first rail on the other side of the second rail in the width direction.

9. The travel assistance device as set forth in claim 4, wherein the first rail is provided so as to be positioned on one side of the second rail in the width direction, the first rail is further provided so as to be positioned on the other side of the second rail in the width direction, and wherein the first runner is provided so as to be guided by the first rail on one side of the second rail in the width direction, and the first runner is further provided so as to be guided by the first rail on the other side of the second rail in the width direction.

10. The travel assistance device as set forth in claim 3, comprising:

a first locking mechanism suppressing a movement of the switch portion in an unlockable manner when the travelling body is configured to be moved into the state in which the load is applied onto the side of the first runner;

a second locking mechanism suppressing the movement of the switch portion in the unlockable manner when the travelling body is configured to be moved into the state in which the load is applied onto the side of the second runner;

a third locking mechanism maintaining the state in which the load is applied onto the side of the first runner in the unlockable manner; and a fourth locking mechanism maintaining the state in which the load is applied onto the side of the second runner in the unlockable manner.

11. The travel assistance device as set forth in claim 10, wherein in a state of suppressing the movement of the switch portion by the first locking mechanism, the third locking mechanism is in a locked state and the first mechanism is unlocked when the travelling body is moved relative to the switch portion into the state in which the load is applied onto the side of the first runner, and the third locking mechanism is unlocked when the travelling body further moves in such a manner that the switch portion is at a position where the movement of the switch portion is suppressed by the second locking mechanism, and wherein in a state of suppressing the movement of the switch portion by the second locking mechanism, the fourth locking mechanism is in the locked state and the second mechanism is unlocked when the travelling body is moved relative to the switch portion into the state in which the load is applied onto the side of the second runner, and the fourth locking mechanism is unlocked when the travelling body further moves in such a manner that the switch portion is at a position where the movement of the switch portion is suppressed by the first locking mechanism.

12. The travel assistance device as set forth in claim 11, wherein the first rail is provided so as to be positioned on one side of the second rail in the width direction, the first rail is further provided so as to be positioned on the other side of the second rail in the width direction, and wherein the first runner is provided so as to be guided by the first rail on one side of the second rail in the width direction, and the first runner is further provided so as to be guided by the first rail on the other side of the second rail in the width direction.

13. The travel assistance device as set forth in claim 10, wherein the first rail is provided so as to be positioned on one side of the second rail in the width direction, the first rail is further provided so as to be positioned on the other side of the second rail in the width direction, and wherein the first runner is provided so as to be guided by the first rail on one side of the second rail in the width direction, and the first runner is further provided so as to be guided by the first rail on the other side of the second rail in the width direction.

14. The travel assistance device as set forth in claim 3, wherein the first rail is provided so as to be positioned on one side of the second rail in the width direction, the first rail is further provided so as to be positioned on the other side of the second rail in the width direction, and wherein the first runner is provided so as to be guided by the first rail on one side of the second rail in the width direction, and the first runner is further provided so as to be guided by the first rail on the other side of the second rail in the width direction.

15. The travel assistance device as set forth in claim 2, wherein the first rail is provided in pairs so as to be positioned on one side of the second rail in the width direction, the first rail is further provided so as to be positioned on the other side of the second rail in the width direction, and wherein the first runner is provided so as to be guided by the first rail on one side of the second rail in the width direction, and the first runner is further provided so as to be guided by the first rail on the other side of the second rail in the width direction.

16. The travel assistance device as set forth in claim 1, wherein a plurality of holding members are provided so as to hold the travelling body at a plurality of regions apart from each other in direction along the rail longitudinal direction, and wherein a plurality of first rails and second rails respectively guiding the runners of the plurality of holding members are provided in tandem.

17. A sliding door device, comprising:

the travel assistance device as set forth in claim 1; and a door body of the travelling body assisted to travel by the travel assistance device.

18. The travel assistance device as set forth in claim 1, wherein, in addition to the holding member holding a first region of the travelling body in a direction along the rail longitudinal direction, a second region holding member holding a second region of the travelling body in the direction along the rail longitudinal direction is provided, and wherein the first rail and the second rail guiding the runner portion of the holding member and a third rail guiding the runner portion of the second region holding member and arranged so as to extend into horizontal direction are provided in tandem.

* * * * *